US009718277B2

(12) United States Patent
Kudo et al.

(10) Patent No.: US 9,718,277 B2
(45) Date of Patent: Aug. 1, 2017

(54) TANK, TANK UNIT AND LIQUID EJECTION SYSTEM

(71) Applicant: SEIKO EPSON CORPORATION, Tokyo (JP)

(72) Inventors: Shoma Kudo, Shiojiri (JP); Naomi Kimura, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/072,826

(22) Filed: Mar. 17, 2016

(65) Prior Publication Data

US 2016/0271967 A1 Sep. 22, 2016

(30) Foreign Application Priority Data

Mar. 19, 2015 (JP) ..... 2015-055789

(51) Int. Cl.
*B41J 2/19* (2006.01)
*B41J 2/175* (2006.01)
*B41J 29/13* (2006.01)

(52) U.S. Cl.
CPC ..... *B41J 2/19* (2013.01); *B41J 2/17509* (2013.01); *B41J 2/17513* (2013.01); *B41J 29/13* (2013.01); *B41J 2202/07* (2013.01)

(58) Field of Classification Search
None
See application file for complete search history.

(56) References Cited

U.S. PATENT DOCUMENTS 6,527,381 B1 * 3/2003 Udagawa ..... B41J 2/17503 347/86
8,926,073 B2 1/2015 Shimizu et al.

FOREIGN PATENT DOCUMENTS

JP 2012-020495 A 2/2012

* cited by examiner

*Primary Examiner* — Lisa M Solomon
(74) *Attorney, Agent, or Firm* — Foley & Lardner LLP

(57) ABSTRACT

To solve the problem of a liquid supply unit of the related art in that liquid supply may become difficult.
The invention provides a tank capable of supplying a liquid to a liquid ejection head, the tank including: a liquid containing portion capable of containing the liquid; and an atmospheric air introducing portion constituting an atmospheric air flow channel capable of introducing atmospheric air into the liquid containing portion, wherein the atmospheric air introducing portion includes a buffer chamber capable of containing the atmospheric air, a liquid retaining member is housed in the buffer chamber, and in a state in which the liquid retaining member is housed in the buffer chamber, a gap that allows the atmospheric air to move between a first communication port and a second communication port of the atmospheric air flow channel is provided within the buffer chamber.

16 Claims, 17 Drawing Sheets

TANK, TANK UNIT AND LIQUID EJECTION SYSTEM

CROSS-REFERENCE TO RELATED APPLICATION

The entire disclosure of Japanese Patent Application No. 2015-055789, filed Mar. 19, 2015 is expressly incorporated by reference herein.

BACKGROUND

1. Technical Field

The present invention relates to a liquid supply unit and the like.

2. Related Art

An inkjet printer has long been known as an example of a liquid ejection apparatus. The inkjet printer can perform printing onto a print medium such as print paper by discharging ink, which is an example of a liquid, from an ejection head to the print medium. It has long been known that the inkjet printer is configured to supply ink stored in a tank, which is an example of a liquid supply unit, to the ejection head. The tank is provided with an ink injection inlet. The user can load ink into the tank from the ink injection inlet. It has long been known that the tank has a configuration in which a liquid containing chamber in which ink is contained and an air containing chamber into which atmospheric air is introduced communicate with each other by a communication portion (see, for example, JP-A-2012-20495). The configuration in which the liquid supply unit is attached to the liquid ejection apparatus is referred to as a liquid ejection system.

In the tank disclosed in JP-A-2012-20495 mentioned above, for example, even if the ink contained in the liquid containing chamber flows out to the air containing chamber side via the communication portion, the ink that has flowed into the air containing chamber can be stored in the air containing chamber. For this reason, with this tank, leakage of the ink contained in the liquid containing chamber to the outside via an atmospheric air opening is easily suppressed. However, if the orientation of the inkjet printer is changed with the ink having flowed into the air containing chamber from the liquid containing chamber, the ink contained in the air containing chamber may flow to the outside of the tank via the atmospheric air opening. To address this, it is considered effective to house a liquid retaining member in the air containing chamber. The liquid retaining member is a member having a high level of ability to absorb and retain a liquid such as ink. The material of the liquid retaining member can be, for example, sponge, sea sponge or the like. By housing the liquid retaining member in the air containing chamber, the ink that has flowed into the air containing chamber from the liquid containing chamber can be retained by the liquid retaining member, and thus the ink is likely to remain in the air containing chamber. However, if the ink that has flowed into the air containing chamber is absorbed by the liquid retaining member, a flow of the atmospheric air may be blocked by the liquid retaining member. In other words, if the ink that has flowed into the air containing chamber is absorbed by the liquid retaining member, entry of the atmospheric air into the liquid containing chamber from the atmospheric air opening may be blocked. If the entry of the atmospheric air into the liquid containing chamber is blocked, along with printing onto a print medium, or in other words, along with consumption of the ink contained in liquid containing chamber, the pressure within the liquid containing chamber becomes lower than the atmospheric pressure. If such a situation occurs, it becomes difficult to supply ink from the tank to the ejection head. In other words, the liquid supply unit of the related art is problematic in that liquid supply may become difficult.

SUMMARY

The invention can solve at least the problem described above, and may be implemented as embodiments or application examples described below.

Application Example 1

A tank capable of supplying a liquid to a liquid ejection head, the tank including: a liquid containing portion capable of containing the liquid; and an atmospheric air introducing portion constituting an atmospheric air flow channel capable of introducing atmospheric air into the liquid containing portion, wherein the atmospheric air introducing portion includes a buffer chamber capable of containing the atmospheric air, the buffer chamber is provided with a first communication port located at a position on the liquid containing portion side in the atmospheric air flow channel and a second communication port located at a position on a side opposite to the liquid containing portion in the atmospheric air flow channel, a liquid retaining member is housed in the buffer chamber, and in a state in which the liquid retaining member is housed in the buffer chamber, a gap that allows the atmospheric air to move between the first communication port and the second communication port is provided within the buffer chamber.

In the tank according to this application example, because the gap that allows the atmospheric air to move between the first communication port and the second communication port is formed within the buffer chamber, even if the liquid permeates into the liquid retaining member in the buffer chamber and the gap of the liquid retaining member is closed by the liquid, the atmospheric air easily flows into the liquid containing portion from the atmospheric air introducing portion. As a result, the reduction in the pressure of the liquid containing portion can be suppressed, and thus the liquid can be easily supplied to the liquid ejection head from the tank.

Application Example 2

The tank according to the above-described application example, wherein the gap is provided between the liquid retaining member and an inner wall constituting the buffer chamber.

In the tank according to this application example, the gap is provided between the liquid retaining member and the inner wall constituting the buffer chamber, and thus the atmospheric air can easily move between the first communication port and the second communication port. For this reason, even if the liquid contained in the buffer chamber permeates into the liquid retaining member and the gap of the liquid retaining member is closed by the liquid, the atmospheric air easily flows into the liquid containing portion from the atmospheric air introducing portion. As a result, the reduction in the pressure of the liquid containing portion can be suppressed, and thus the liquid can be easily supplied to the liquid ejection head from the tank.

Application Example 3

The tank according to the above-described application example, wherein a dimension in a vertical direction of the liquid retaining member is smaller than a dimension in the vertical direction of the buffer chamber, and a dimension in a horizontal direction of the liquid retaining member is smaller than a dimension in the horizontal direction of the buffer chamber, the horizontal direction being perpendicular to the vertical direction.

In the tank according to this application example, a gap that allows the atmospheric air to move between the first communication port and the second communication port can be formed within the buffer chamber. For this reason, even if the liquid contained in the buffer chamber permeates into the liquid retaining member and the gap of the liquid retaining member is closed by the liquid, the atmospheric air easily flows into the liquid containing portion from the atmospheric air introducing portion. As a result, the reduction in the pressure of the liquid containing portion can be suppressed, and thus the liquid can be easily supplied to the liquid ejection head from the tank. Furthermore, in the tank according to this application example, by reducing the dimensions of the liquid retaining member, the cost for the liquid retaining member can be reduced.

Application Example 4

The tank according to the above-described application example, including a protrusion protruding from an inner wall of the buffer chamber toward the liquid retaining member.

In the tank according to this application example, with the protrusion protruding from the inner wall of the buffer chamber toward the liquid retaining member, a gap that allows the atmospheric air to move between the first communication port and the second communication port can be formed within the buffer chamber. For this reason, even if the liquid contained in the buffer chamber permeates into the liquid retaining member and the gap of the liquid retaining member is closed by the liquid, the atmospheric air easily flows into the liquid containing portion from the atmospheric air introducing portion. As a result, the reduction in the pressure of the liquid containing portion can be suppressed, and thus the liquid can be easily supplied to the liquid ejection head from the tank. Furthermore, in the tank according to this application example, even if there are variations in the dimensions of the liquid retaining member, the gap can be ensured by the protrusion, and thus the reduction in the pressure of the liquid containing portion can be further suppressed.

Application Example 5

The tank according to the above-described application example, including: a first protrusion protruding in a vertical direction from an inner wall of the buffer chamber toward the liquid retaining member; and a second protrusion protruding in a horizontal direction, which is perpendicular to the vertical direction, from the inner wall of the buffer chamber toward the liquid retaining member.

In the tank according to this application example, with the first protrusion and the second protrusion protruding from the inner wall of the buffer chamber toward the liquid retaining member, a gap that allows the atmospheric air to move between the first communication port and the second communication port can be formed within the buffer chamber. For this reason, even if the liquid contained in the buffer chamber permeates into the liquid retaining member and the gap of the liquid retaining member is closed by the liquid, the atmospheric air easily flows into the liquid containing portion from the atmospheric air introducing portion. As a result, the reduction in the pressure of the liquid containing portion can be suppressed, and thus the liquid can be easily supplied to the liquid ejection head from the tank. Furthermore, in the tank according to this application example, even if there are variations in the dimensions of the liquid retaining member, the gap can be ensured by the protrusions, and thus the reduction in the pressure of the liquid containing portion can be further suppressed.

Application Example 6

The tank according to the above-described application example, including a protrusion protruding from the liquid retaining member toward an inner wall of the buffer chamber.

In the tank according to this application example, with the protrusion protruding from the liquid retaining member toward the inner wall of the buffer chamber, a gap that allows the atmospheric air to move between the first communication port and the second communication port can be formed within the buffer chamber. For this reason, even if the liquid contained in the buffer chamber permeates into the liquid retaining member and the gap of the liquid retaining member is closed by the liquid, the atmospheric air easily flows into the liquid containing portion from the atmospheric air introducing portion. As a result, the reduction in the pressure of the liquid containing portion can be suppressed, and thus the liquid can be easily supplied to the liquid ejection head from the tank. Furthermore, in the tank according to this application example, the face contact between the inner wall of the buffer chamber and the liquid retaining member can be easily avoided. For example, in a configuration in which the inner wall of the buffer chamber and the liquid retaining member are in face contact with each other, the attraction force between the inner wall and the liquid retaining member into which the liquid has permeated increases, and it is considered that the liquid retaining member is fixed. At this time, if the liquid retaining member is fixed while covering the first communication port, it is difficult for the atmospheric air to move between the first communication port and the second communication port. As a result, it is considered that the pressure in the liquid containing portion is likely to decrease. In contrast, in the tank of this application example, with the protrusion protruding from the liquid retaining member toward the inner wall of the buffer chamber, the face contact between the inner wall of the buffer chamber and the liquid retaining member can be easily avoided. Accordingly, the reduction in the pressure of the liquid containing portion can be further suppressed.

Application Example 7

The tank according to the above-described application example, including: a first protrusion protruding in a vertical direction from the liquid retaining member toward an inner wall of the buffer chamber; and a second protrusion protruding in a horizontal direction, which is perpendicular to the vertical direction, from the liquid retaining member toward the inner wall of the buffer chamber.

In the tank according to this application example, with the first protrusion and the second protrusion protruding from the liquid retaining member toward the inner wall of the buffer chamber, a gap that allows the atmospheric air to move between the first communication port and the second communication port can be formed within the buffer chamber. For this reason, even if the liquid contained in the buffer chamber permeates into the liquid retaining member and the gap of the liquid retaining member is closed by the liquid, the atmospheric air easily flows into the liquid containing portion from the atmospheric air introducing portion. As a result, the reduction in the pressure of the liquid containing portion can be suppressed, and thus the liquid can be easily supplied to the liquid ejection head from the tank. Furthermore, in the tank according to this application example, the face contact between the inner wall of the buffer chamber and the liquid retaining member can be easily avoided. For example, in a configuration in which the inner wall of the buffer chamber and the liquid retaining member are in face contact with each other, the attraction force between the inner wall and the liquid retaining member into which the liquid has permeated increases, and it is considered that the liquid retaining member is fixed. At this time, if the liquid retaining member is fixed while covering the first communication port, it is difficult for the atmospheric air to move between the first communication port and the second communication port. As a result, it is considered that the pressure in the liquid containing portion is likely to decrease. In contrast, in the tank of this application example, with the protrusions protruding from the liquid retaining member toward the inner wall of the buffer chamber, the face contact between the inner wall of the buffer chamber and the liquid retaining member can be easily avoided. Accordingly, the reduction in the pressure of the liquid containing portion can be further suppressed.

Application Example 8

The tank according to the above-described application example, including a support member located in the gap between an inner wall of the buffer chamber and the liquid retaining member.

In the tank according to this application example, with the support member located in the gap between the inner wall of the buffer chamber and the liquid retaining member, a gap that allows the atmospheric air to move between the first communication port and the second communication port can be formed within the buffer chamber. For this reason, even if the liquid contained in the buffer chamber permeates into the liquid retaining member and the gap of the liquid retaining member is closed by the liquid, the atmospheric air easily flows into the liquid containing portion from the atmospheric air introducing portion. As a result, the reduction in the pressure of the liquid containing portion can be suppressed, and thus the liquid can be easily supplied to the liquid ejection head from the tank. Furthermore, in the tank according to this application example, the face contact between the inner wall of the buffer chamber and the liquid retaining member can be easily avoided. For example, in a configuration in which the inner wall of the buffer chamber and the liquid retaining member are in face contact with each other, the attraction force between the inner wall and the liquid retaining member into which the liquid has permeated increases, and it is considered that the liquid retaining member is fixed. At this time, if the liquid retaining member is fixed while covering the first communication port, it is difficult for the atmospheric air to move between the first communication port and the second communication port. As a result, it is considered that the pressure in the liquid containing portion is likely to decrease. In contrast, in the tank of this application example, with the support member located in the gap between the inner wall of the buffer chamber and the liquid retaining member, the face contact between the inner wall of the buffer chamber and the liquid retaining member can be easily avoided. Accordingly, the reduction in the pressure of the liquid containing portion can be further suppressed.

Application Example 9

The tank according to the above-described application example, including a first support member located in a gap in a vertical direction between an inner wall of the buffer chamber and the liquid retaining member; and a second support member located in a gap in a horizontal direction between the inner wall of the buffer chamber and the liquid retaining member, the horizontal direction being perpendicular to the vertical direction.

In the tank according to this application example, with the first support member and the second support member located in the gap between the inner wall of the buffer chamber and the liquid retaining member, a gap that allows the atmospheric air to move between the first communication port and the second communication port can be formed within the buffer chamber. For this reason, even if the liquid contained in the buffer chamber permeates into the liquid retaining member and the gap of the liquid retaining member is closed by the liquid, the atmospheric air easily flows into the liquid containing portion from the atmospheric air introducing portion. As a result, the reduction in the pressure of the liquid containing portion can be suppressed, and thus the liquid can be easily supplied to the liquid ejection head from the tank. Furthermore, in the tank according to this application example, the face contact between the inner wall of the buffer chamber and the liquid retaining member can be easily avoided. For example, in a configuration in which the inner wall of the buffer chamber and the liquid retaining member are in face contact with each other, the attraction force between the inner wall and the liquid retaining member into which the liquid has permeated increases, and it is considered that the liquid retaining member is fixed. At this time, if the liquid retaining member is fixed while covering the first communication port, it is difficult for the atmospheric air to move between the first communication port and the second communication port. As a result, it is considered that the pressure in the liquid containing portion is likely to decrease. In contrast, in the tank of this application example, with the first support member and the second support member located in the gap between the inner wall of the buffer chamber and the liquid retaining member, the face contact between the inner wall of the buffer chamber and the liquid retaining member can be easily avoided. Accordingly, the reduction in the pressure of the liquid containing portion can be further suppressed.

Application Example 10

The tank according to the above-described application example, wherein the liquid retaining member includes a plurality of plate-like members and a binding member that bundles the plurality of plate-like members.

In the tank according to this application example, the liquid retaining member has a configuration in which a plurality of plate-like members are bundled by a binding member. In the tank according to this application example, the liquid retaining member can be configured to fit into buffer chambers of various sizes by adjusting the number of plate-like members bundled. With this configuration, the plate-like members can be used commonly in buffer chambers of various sizes. As a result, the cost for the liquid retaining member can be easily reduced.

Application Example 11

The tank according to the above-described application example, further including: a liquid injection portion capable of injecting the liquid into the liquid containing portion; and a cap member that is detachably attached to the liquid injection portion.

In the tank according to this application example, a gap that allows the atmospheric air to move between the first communication port and the second communication port is provided within the buffer chamber, and thus even if the liquid contained in the buffer chamber permeates into the liquid retaining member and the gap of the liquid retaining member is closed by the liquid, the atmospheric air easily flows into the liquid containing portion from the atmospheric air introducing portion. As a result, the change in the pressure of the liquid containing portion can be suppressed. Here, for example, if the pressure within the liquid containing chamber increases to a level higher than the atmospheric pressure, with a flow of the atmospheric air into the liquid containing chamber being blocked, the cap member attached to the liquid injection portion may be detached therefrom. To address this, in the tank of this application example, the gap that allows the atmospheric air to move between the first communication port and the second communication port is provided within the buffer chamber, and thus the atmospheric air can easily flow out of the tank from the liquid containing portion. As a result, in the tank according to this application example, it is possible to use a detachable cap member.

Application Example 12

The tank according to the above-described application example, wherein the buffer chamber includes a first atmospheric air introducing inlet formed at an intersection with the liquid containing portion and a second atmospheric air introducing inlet that is open toward outside of the tank, and the first communication port is the first atmospheric air introducing inlet, and the second communication port is the second atmospheric air introducing inlet.

Application Example 13

The tank according to the above-described application example, wherein the atmospheric air introducing portion further includes a first atmospheric air communication path that communicates between the buffer chamber and the liquid containing portion, the first atmospheric air communication path includes a first atmospheric air introducing inlet formed at an intersection with the liquid containing portion, and the first communication port is an area where the buffer chamber is connected to the first atmospheric air communication path.

Because the tank according to this application example is provided with the first atmospheric air communication path, it is possible to make it difficult for the liquid to leak to the outside from the atmospheric air introducing portion.

Application Example 14

The tank according to the above-described application example, wherein the atmospheric air introducing portion further includes a second atmospheric air communication path that communicates between the buffer chamber and outside of the tank, the second atmospheric air communication path includes a second atmospheric air introducing inlet that is open toward the outside of the tank, and the second communication port is an area where the buffer chamber is connected to the second atmospheric air communication path.

Because the tank according to this application example is provided with the second atmospheric air communication path, it is possible to make it difficult for the liquid to leak to the outside from the atmospheric air introducing portion.

Application Example 15

The tank according to the above-described application example, wherein when it is assumed that the buffer chamber is a first buffer chamber, the second atmospheric air communication path includes a second buffer chamber that is smaller than the first buffer chamber, the second buffer chamber is located further upstream of the atmospheric air flow channel than the first buffer chamber, when it is assumed that the liquid retaining member is a first liquid retaining member, a second liquid retaining member that is smaller than the first liquid retaining member is housed in the second buffer chamber, and in a state in which the second liquid retaining member is housed in the second buffer chamber, a gap that allows the atmospheric air to move between the outside and the first buffer chamber is provided within the second buffer chamber.

Because the tank according to this application example is provided with the second buffer chamber, it is possible to make it difficult for the liquid to leak to the outside from the atmospheric air introducing portion.

Application Example 16

A tank unit including: the tank according to the above-described application example; and a case that houses the tank.

In the tank unit according to this application example, the tank can be protected by the case.

Application Example 17

A liquid ejection system including: the tank unit according to the above-described application example; a tube connected to the tank unit; and a liquid ejection apparatus connected to the tank unit via the tube, wherein when it is assumed that the case is a first case, the liquid ejection apparatus includes the liquid ejection head and a second case that houses the liquid ejection head.

In the liquid ejection system according to this application example, the tank can be protected by the first case, and the liquid ejection head can be protected by the second case.

BRIEF DESCRIPTION OF THE DRAWINGS

The invention will be described with reference to the accompanying drawings, wherein like numbers reference like elements.

DESCRIPTION OF EXEMPLARY EMBODIMENTS

An embodiment will be described with reference to the drawings by taking a liquid ejection system as an example. In the diagrams, in order to show constituent elements so as to be recognizable, the constituent elements and members may be scaled differently.

Figure 1:
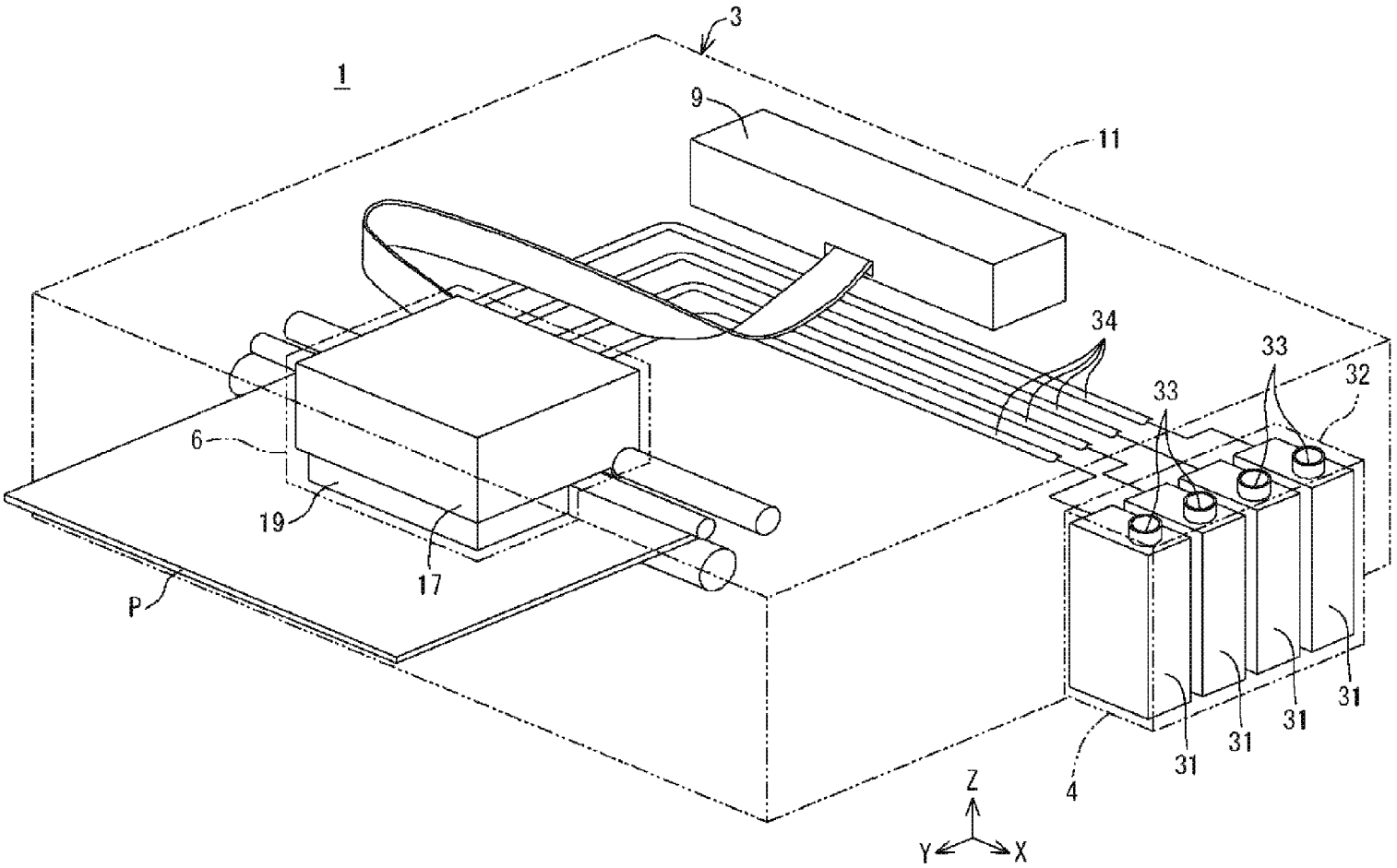
FIG. 1 is a perspective view showing main constituent elements of a liquid ejection system according to an embodiment of the invention.

A liquid ejection system 1 according to the present embodiment includes, as shown in FIG. 1, a printer 3, which is an example of a liquid ejection apparatus, and an ink supply apparatus 4, which is an example of a liquid supply apparatus. The printer 3 includes a recording portion 6 and a control portion 9. In FIG. 1, X, Y and Z axes, which are mutually perpendicular coordinate axes, are shown. In the diagrams mentioned hereinafter, the X, Y and Z axes are shown as appropriate. In the present embodiment, a state in which the liquid ejection system 1 is disposed on a horizontal plane (XY plane) defined by the X axis and the Y axis is the in-use state of the liquid ejection system 1. The Z axis is an axis perpendicular to the horizontal plane. In the in-use state of the liquid ejection system 1, the Z axis direction is the vertically upward direction. Also, in the in-use state of the liquid ejection system 1, in FIG. 1, −Z axis direction is the vertically downward direction. In each of the X, Y and Z axes, the direction of the arrow indicates the positive (+) direction, and a direction opposite to the direction of the arrow indicates the negative (−) direction.

In the printer 3, the recording portion 6 and the control portion 9 are housed in a housing 11. The recording portion 6 performs recording on a recording medium P conveyed in the Y axis direction by a conveyance apparatus (not shown) by using ink, which is an example of liquid. The unshown conveyance apparatus intermittently conveys the recording medium P such as recording paper in the Y axis direction. The recording portion 6 is configured so as to be capable of reciprocal movement along the X axis by a moving apparatus (not shown). The ink supply apparatus 4 supplies ink to the recording portion 6. The control portion 9 controls driving of the above-described constituent elements. In the liquid ejection system 1, at least a part of the ink supply apparatus 4 protrudes to the outside of the housing 11. The recording portion 6 is housed in the housing 11, which is an example of a second case. With this configuration, the recording portion 6 can be protected by the housing 11.

The direction along the X axis is not limited to the direction completely parallel to the X axis, and encompasses directions inclined due to error, tolerance or the like excluding the direction perpendicular to the X axis. Likewise, the direction along the Y axis is not limited to the direction completely parallel to the Y axis, and encompasses directions inclined due to error, tolerance or the like excluding the direction perpendicular to the Y axis. The direction along the Z axis is not limited to the direction completely parallel to the Z axis, and encompasses directions inclined due to error, tolerance or the like excluding the direction perpendicular to the Z axis. In other words, the direction along an arbitrary axis or plane is not limited to the direction completely parallel to the arbitrary axis or plane, and encompasses directions inclined due to error, tolerance or the like excluding the direction perpendicular to the arbitrary axis or plane.

The recording portion 6 includes a carriage 17 and a recording head 19. The recording head 19 is an example of a liquid ejection head, and performs recording on the recording medium P by discharging ink in the form of ink droplets. The carriage 17 includes the recording head 19 mounted thereon. The recording head 19 is electrically connected to the control portion 9. The discharge of ink droplets from the recording head 19 is controlled by the control portion 9.

As shown in FIG. 1, the ink supply apparatus 4, which is an example of a tank unit, includes a tank 31, which is an example of a liquid supply unit. In the present embodiment, the ink supply apparatus 4 includes a plurality of (four in the present embodiment) tanks 31. The plurality of tanks 31 protrude to the outside of the housing 11 of the printer 3. The plurality of tanks 31 are housed in a housing 32. With this configuration, the tanks 31 can be protected by the housing 32. The housing 32, which is an example of a first case, protrudes from the housing 11.

Figure 2:
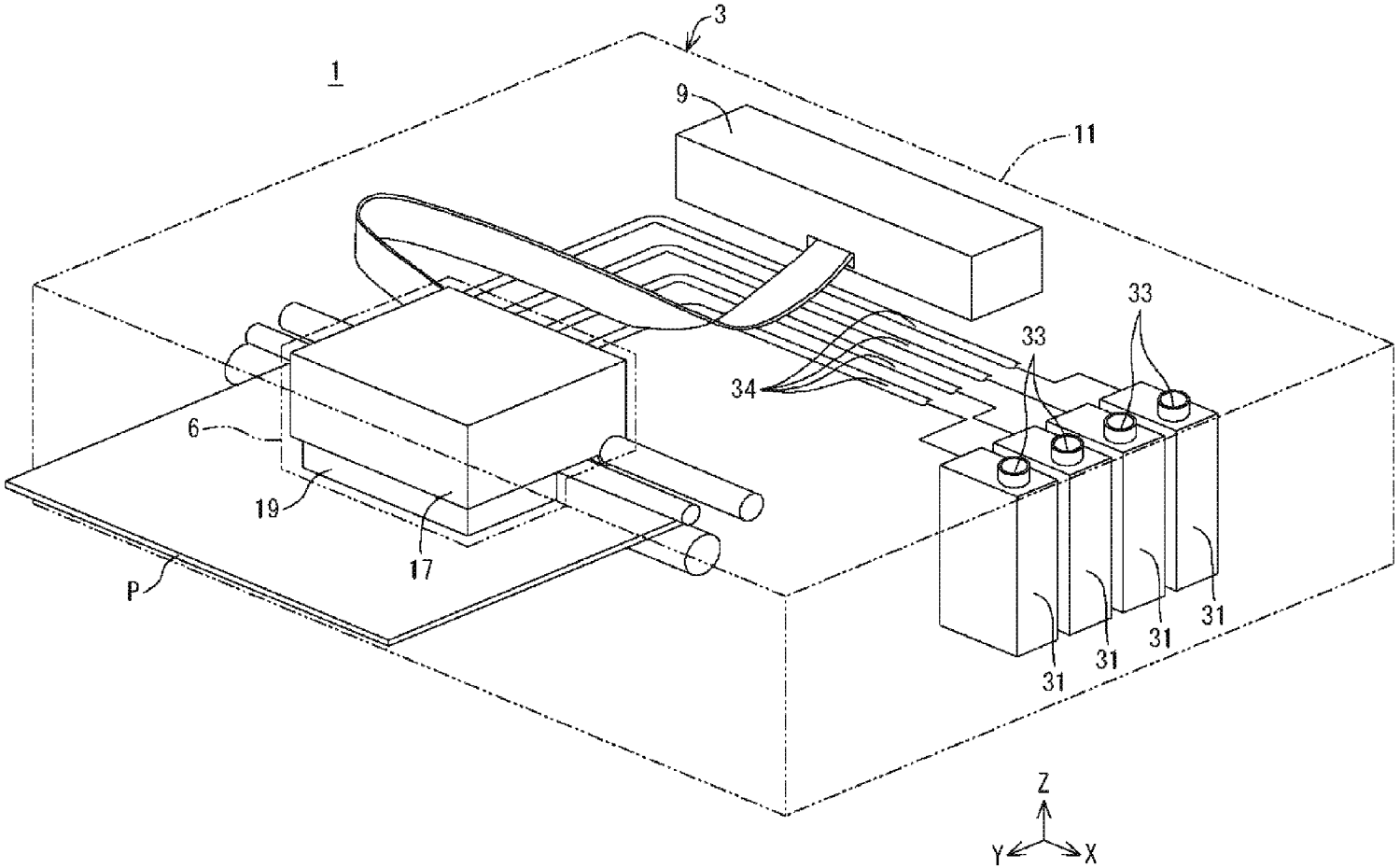
FIG. 2 is a perspective view showing another example of the main constituent elements of the liquid ejection system of the embodiment.

The housing 32 and the housing 11 may be provided as separate units or integrated as a single unit. If the housing 32 and the housing 11 are integrated as a single unit, it can be said that the plurality of tanks 31 are housed together with the recording head 19 and ink supply tubes 34 in the housing 11, as shown in FIG. 2.

Each tank 31 contains an ink, which is an example of a liquid. The tank 31 is provided with a liquid injection portion 33. With the tank 31, an ink can be injected into the tank 31 via the liquid injection portion 33 from the outside of the tank 31. The operator can access the liquid injection portion 33 of the tank 31 from the outside of the housing 32. Also, the liquid injection portion 33 is sealed by a lid (not shown). When an ink is injected into the tank 31, the liquid injection portion 33 is opened by detaching the lid before injection of the ink.

An ink supply tube 34 is connected to each tank 31. The ink contained in the tank 31 is supplied from the ink supply apparatus 4 to the recording head 19 via the ink supply tube 34. Then, the ink supplied to the recording head 19 is discharged in the form of ink droplets from a nozzle (not shown) directed toward the recording medium P side. In the above-described example, the printer 3 and the ink supply apparatus 4 are described as separate constituent elements, but the ink supply apparatus 4 may be included in the configuration of the printer 3.

In the liquid ejection system 1 having the above-described configuration, the recording medium P is conveyed in the Y axis direction, and the carriage 17 is reciprocally moved along the X axis, and at the same time, the recording head 19 is caused to discharge ink droplets at predetermined positions, whereby recording is performed on the recording medium P. These operations are controlled by the control portion 9.

The ink is not limited to either water-based ink or oil-based ink. As the water-based ink, any of those having a configuration in which a solute such as a dye is dissolved in an aqueous solvent and those having a configuration in which a dispersoid such as a pigment is dispersed in an aqueous dispersion medium may be used. As the oil-based ink, any of those having a configuration in which a solute such as a dye is dissolved in an oil-based solvent and those having a configuration in which a dispersoid such as a pigment is dispersed in an oil-based dispersion medium may be used.

Various examples of the tank 31 will be described. In the following description, in order to identify a tank 31 of each example, a different alphabet is attached to the reference numeral of the tank 31 of each example.

Example 1

Figure 3:
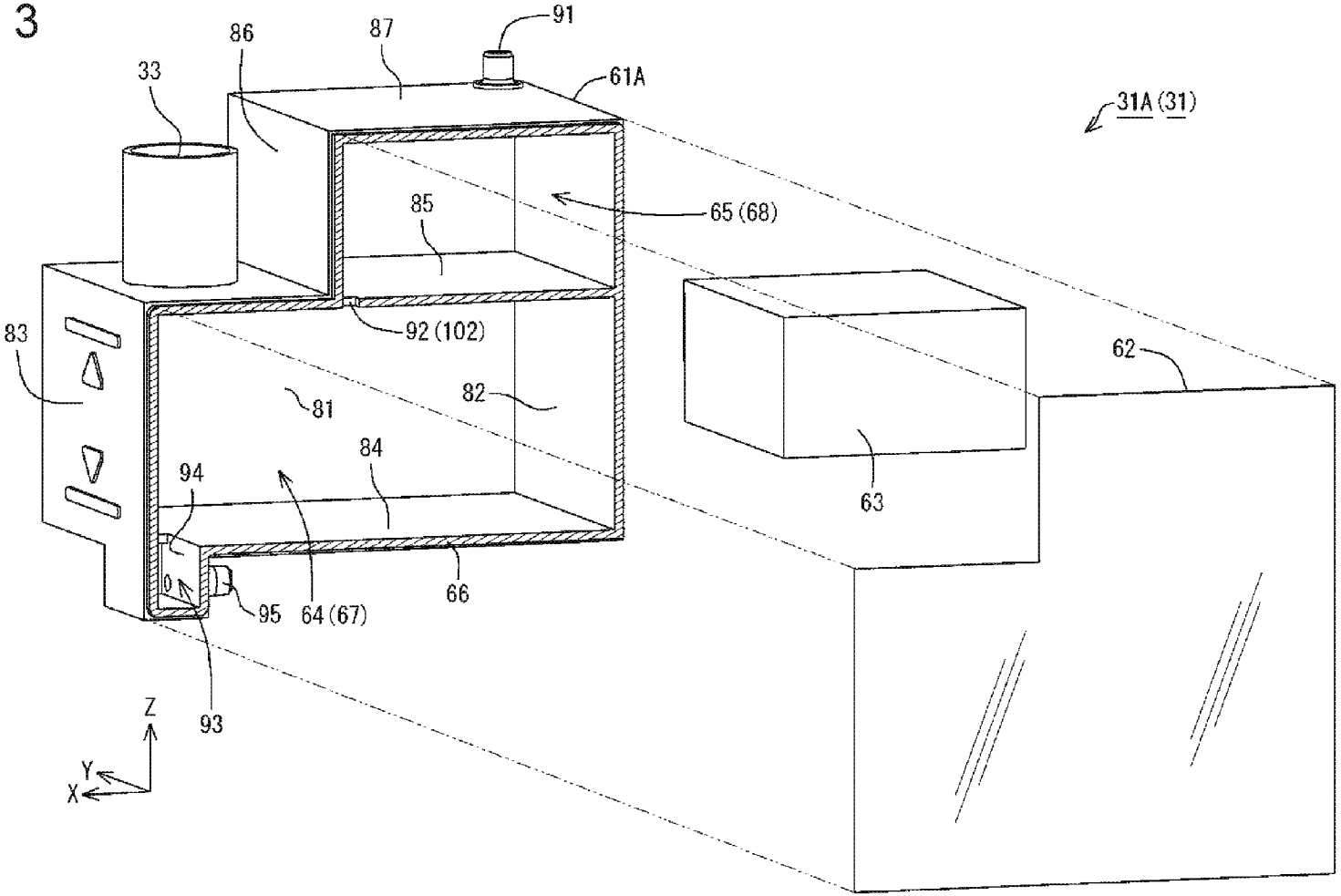
FIG. 3 is an exploded perspective view showing a tank according to Example 1.

A tank 31A according to Example 1 will be described. As shown in FIG. 3, the tank 31A includes a case 61A, which is an example of a tank body, a sheet member 62 and a liquid retaining member 63. The case 61A is made of, for example, synthetic resin such as nylon or polypropylene. Also, the sheet member 62 is formed in a film by using synthetic resin (for example, nylon, polypropylene or the like), and has flexibility. In the present embodiment, the sheet member 62 is light-transmissive.

The liquid retaining member 63 has a property that absorbs a liquid and retaining the absorbed liquid. As the material of the liquid retaining member 63, for example, various materials such as foam, felt and non-woven fabric can be used.

The case 61A includes a hollow 64 and a hollow 65. The liquid retaining member 63 is housed in the hollow 65. The case 61A is provided with a bonding portion 66. In FIG. 3, for the sake of clarity of the configuration, the bonding portion 66 is indicated by hatching. The sheet member 62 is bonded to the bonding portion 66 of the case 61A, with the liquid retaining member 63 being housed in the hollow 65. In the present embodiment, the case 61A and the sheet member 62 are bonded by welding. As a result of the sheet member 62 being bonded to the case 61A, the hollow 64 and the hollow 65 are closed by the sheet member 62. A space formed by the hollow 64 and the sheet member 62 will be referred to as "liquid containing portion 67" (described later). Likewise, a space formed by the hollow 65 and the sheet member 62 will be referred to as "buffer chamber 68" (described later). Accordingly, the liquid retaining member 63 is housed in the buffer chamber 68.

As shown in FIG. 3, the case 61A includes a first wall 81, a second wall 82, a third wall 83, a fourth wall 84, a fifth wall 85, a sixth wall 86 and a seventh wall 87. The hollow 64 is located in the −Z axis direction of the fifth wall 85. The hollow 65 is located in the Z axis direction of the fifth wall 85. The hollow 64 and the hollow 65 are stacked along the Z axis with the fifth wall 85 interposed therebetween. The first wall 81 of the hollow 64 and the first wall 81 of the hollow 65 are the same wall. In other words, the hollow 64 and the hollow 65 share the first wall 81.

The hollow 64 is surrounded by the second wall 82, the third wall 83, the fourth wall 84 and the fifth wall 85 when the first wall 81 is viewed planarly in the Y axis direction. Likewise, the hollow 65 is surrounded by the second wall 82, the fifth wall 85, the sixth wall 86 and the seventh wall 87 when the first wall 81 is viewed planarly in the Y axis direction. The second wall 82 of the hollow 64 and the second wall 82 of the hollow 65 are the same wall. In other words, the hollow 64 and the hollow 65 share the second wall 82. Likewise, the fifth wall 85 of the hollow 64 and the fifth wall 85 of the hollow 65 are the same wall. In other words, the hollow 64 and the hollow 65 share the fifth wall 85.

The second to seventh walls 82 to 87 intersect with the first wall 81. The second wall 82 and the third wall 83 are provided at facing positions along the X axis with the first wall 81 interposed therebetween. The second wall 82 and the sixth wall 86 are provided at facing positions along the X axis with the first wall 81 interposed therebetween. The fourth wall 84 and the fifth wall 85 are provided at facing positions along the Z axis with the first wall 81 interposed therebetween. The fifth wall 85 and the seventh wall 87 are provided at facing positions along the Z axis with the first wall 81 interposed therebetween. The second wall 82 intersects with the fourth wall 84, the fifth wall 85 and the seventh wall 87. The third wall 83 intersects with the fourth wall 84 and the fifth wall 85. The sixth wall 86 intersects with the fifth wall 85 and the seventh wall 87.

The second wall 82, the third wall 83, the fourth wall 84 and the fifth wall 85 protrude in the −Y axis direction from the first wall 81. With this configuration, the hollow 64 is constituted by, with the first wall 81 being defined as the main wall, the second wall 82, the third wall 83, the fourth wall 84 and the fifth wall 85 that extend in the −Y axis direction from the main wall. The hollow 64 is configured so as to form a recess extending toward the Y axis direction. The hollow 64 is open toward the −Y axis direction, or in other words, toward the sheet member 62 side. To rephrase it, the hollow 64 is provided so as to form a recess extending toward the Y axis direction, or in other words, a direction opposite to the sheet member 62. As a result of the sheet member 62 being bonded to the case 61A, the hollow 64 is closed by the sheet member 62, and thereby the liquid containing portion 67 is formed.

The sixth wall 86 and the seventh wall 87 protrude in the −Y axis direction from the first wall 81. With this configuration, the hollow 65 is constituted by, with the first wall 81 being defined as the main wall, the second wall 82, the fifth wall 85, the sixth wall 86 and the seventh wall 87 that extend in the −Y axis direction from the main wall. The hollow 65 is configured so as to form a recess extending toward the Y axis direction. The hollow 65 is open toward the −Y axis direction, or in other words, toward the sheet member 62 side. To rephrase it, the hollow 65 is provided so as to form a recess extending toward the Y axis direction, or in other words, a direction opposite to the sheet member 62. As a result of the sheet member 62 being bonded to the case 61A, the hollow 65 is closed by the sheet member 62, and the buffer chamber 68 is formed. The first to seventh walls 81 to 87 are not limited to flat walls, and may have irregularities. Also, the extent to which the second to seventh walls 82 to 87 protrude from the first wall 81 is set to be the same.

The sixth wall 86 and the third wall 83 have a step in the X axis direction. The third wall 83 is located at a position farther toward the X axis direction than the sixth wall 86.

When the first wall 81 is viewed planarly from the sheet member 62 side, the liquid injection portion 33 is present between the third wall 83 and the sixth wall 86. The liquid injection portion 33 is provided on the fifth wall 85. The seventh wall 87 is provided with an introducing path 91. The introducing path 91 extends into the hollow 65. Atmospheric air is introduced into the buffer chamber 68 via the introducing path 91.

Also, a notch 92 is formed in an area of the fifth wall 85 in which the hollow 65 and the hollow 64 intersect with each other. The area of the fifth wall 85 in which the hollow 65 and the hollow 64 intersect with each other is an area of the fifth wall 85 in which the hollow 65 and the hollow 64 are overlaid in the Z axis. The notch 92 is formed in an end portion in the −Y axis direction of the fifth wall 85. The notch 92 is formed so as to form a recess extending toward the Y axis direction from the end portion in the −Y axis direction of the fifth wall 85. Accordingly, when the sheet member 62 is bonded to the case 61A, the hollow 64 and the hollow 65 communicate with each other via the notch 92. A space formed by the notch 92 and the sheet member 62 constitutes at least a part of a first atmospheric air communication portion 102 (described later).

A hollow 93 is provided within the hollow 64. The hollow 93 is provided so as to form a recess extending toward a direction opposite to the fifth wall 85 from the fourth wall 84, or in other words, toward the −Z axis direction from the fourth wall 84. In the hollow 93, a supply inlet 95 is provided on a wall 94 confronting with the third wall 83 and the second wall 82. Accordingly, when the first wall 81 is viewed planarly in the Y axis direction, the supply inlet 95 is present between the third wall 83 and the second wall 82. The liquid injection portion 33 and the supply inlet 95 each communicate between the outside of the case 61A and the inside of the hollow 64. The supply inlet 95 protrudes in the −X axis direction from the wall 94.

As shown in FIG. 3, the sheet member 62 confronts with the first wall 81 with the second to seventh walls 82 to 87 interposed therebetween in the Y axis direction. As viewed planarly in the Y axis direction, the sheet member 62 has a size enough to cover the hollow 64, the hollow 65 and the hollow 93. The sheet member 62 is welded to the bonding portion 66, with a gap between the sheet member 62 and the first wall 81. As a result, the hollow 64, the hollow 65 and the hollow 93 are sealed by the sheet member 62. For this reason, the sheet member 62 can also be regarded as the lid for the case 61A.

Figure 4:
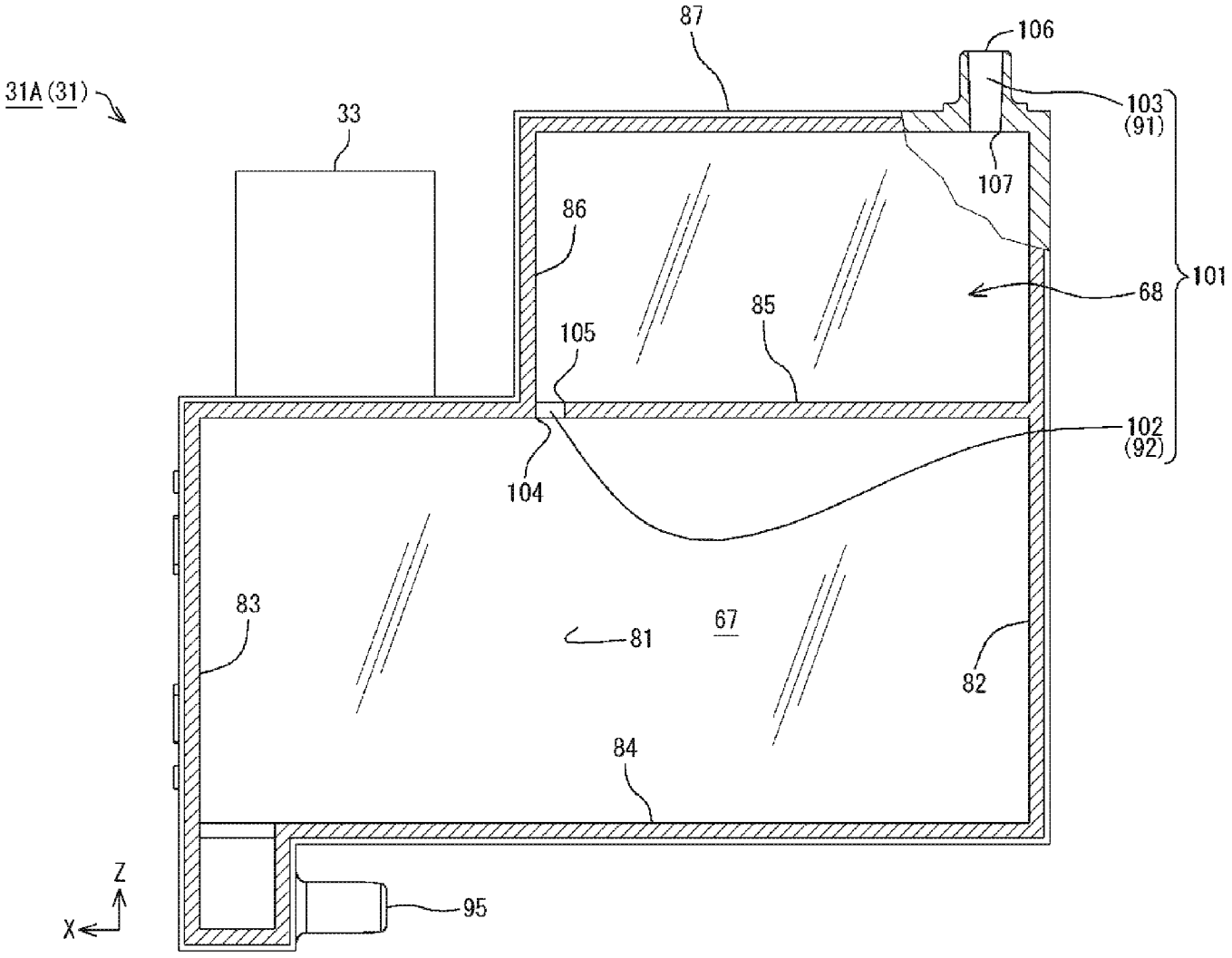
FIG. 4 is a side view of the tank according to Example 1 as viewed from a sheet member side.

As shown in FIG. 4, the tank 31A includes the liquid containing portion 67 and an atmospheric air introducing portion 101. The atmospheric air introducing portion 101 includes the first atmospheric air communication portion 102, the buffer chamber 68 and a second atmospheric air communication portion 103. The first atmospheric air communication portion 102 is an example of a first atmospheric air communication path. The second atmospheric air communication portion 103 is an example of a second atmospheric air communication path. The atmospheric air introducing portion 101 is an atmospheric air flow channel between the outside of the tank 31A and the inside of the liquid containing portion 67. In FIG. 4, in order to clearly indicate the configuration of the second atmospheric air communication portion 103, a partial cross-section of the tank 31A is shown. Also, in FIG. 4, in order to clearly show the configuration, the liquid retaining member 63 is not illustrated.

The atmospheric air introducing portion 101 communicates with the outside of the tank 31A in the second atmospheric air communication portion 103. Also, the atmospheric air introducing portion 101 communicates with the inside of the liquid containing portion 67 in the first atmospheric air communication portion 102. The liquid containing portion 67 communicates with the outside of the tank 31A via the first atmospheric air communication portion 102, the buffer chamber 68 and the second atmospheric air communication portion 103. To rephrase it, the liquid containing portion 67 is open to the atmospheric air via the first atmospheric air communication portion 102, the buffer chamber 68 and the second atmospheric air communication portion 103.

The first atmospheric air communication portion 102 is an atmospheric air flow channel between a first atmospheric air introducing inlet 104 and a first communication port 105. In this example, the first atmospheric air communication portion 102 is formed as the notch 92 formed in the fifth wall 85. Accordingly, in this example, the path length of the first atmospheric air communication portion 102 is equal to the thickness dimension of the fifth wall 85. The first atmospheric air introducing inlet 104 is defined as an opening formed in an intersection where the inner wall of the liquid containing portion 67 and the first atmospheric air communication portion 102 intersect. To rephrase it, the first atmospheric air introducing inlet 104 is an area where the first atmospheric air communication portion 102 is connected to the liquid containing portion 67. Likewise, the first communication port 105 is defined as an opening formed in an intersection where the inner wall of the buffer chamber 68 and the first atmospheric air communication portion 102 intersect. To rephrase it, the first communication port 105 is an area where the first atmospheric air communication portion 102 is connected to the buffer chamber 68.

In this example, the first atmospheric air communication portion 102 is configured as the notch 92 formed in the fifth wall 85, and the path length of the first atmospheric air communication portion 102 is equal to the thickness dimension of the fifth wall 85, and thus the first atmospheric air introducing inlet 104 and the first communication port 105 can be regarded as the same. In other words, in this example, the first communication port 105 can also be regarded as the first atmospheric air introducing inlet 104.

The second atmospheric air communication portion 103 is an atmospheric air flow channel between a second atmospheric air introducing inlet 106 and a second communication port 107. In this example, the second atmospheric air communication portion 103 is configured to include the introducing path 91 formed on the seventh wall 87 and the thickness of the seventh wall 87. Accordingly, in this example, the path length of the second atmospheric air communication portion 103 is equal to a length obtained by addition of the path length of the introducing path 91 and the thickness dimension of the seventh wall 87. The second atmospheric air introducing inlet 106 is defined as an opening that is open toward the outside of the tank in the second atmospheric air communication portion 103. Likewise, the second communication port 107 is defined as an opening formed at an intersection where the inner wall of the buffer chamber 68 and the second atmospheric air communication portion 103 intersect. To rephrase it, the second communication port 107 is an area where the second atmospheric air communication portion 103 is connected to the buffer chamber 68.

In this example, the introducing path 91 is provided, but it is also possible to use a configuration that does not include the introducing path 91. In the tank 31A without the introducing path 91, the path length of the second atmospheric air communication portion 103 is equal to the thickness dimension of the seventh wall 87, and thus the second atmospheric air introducing inlet 106 and the second communication port 107 can be regarded as the same. In other words, in the tank 31A without the introducing path 91, the second communication port 107 can also be regarded as the second atmospheric air introducing inlet 106.

Figure 5:
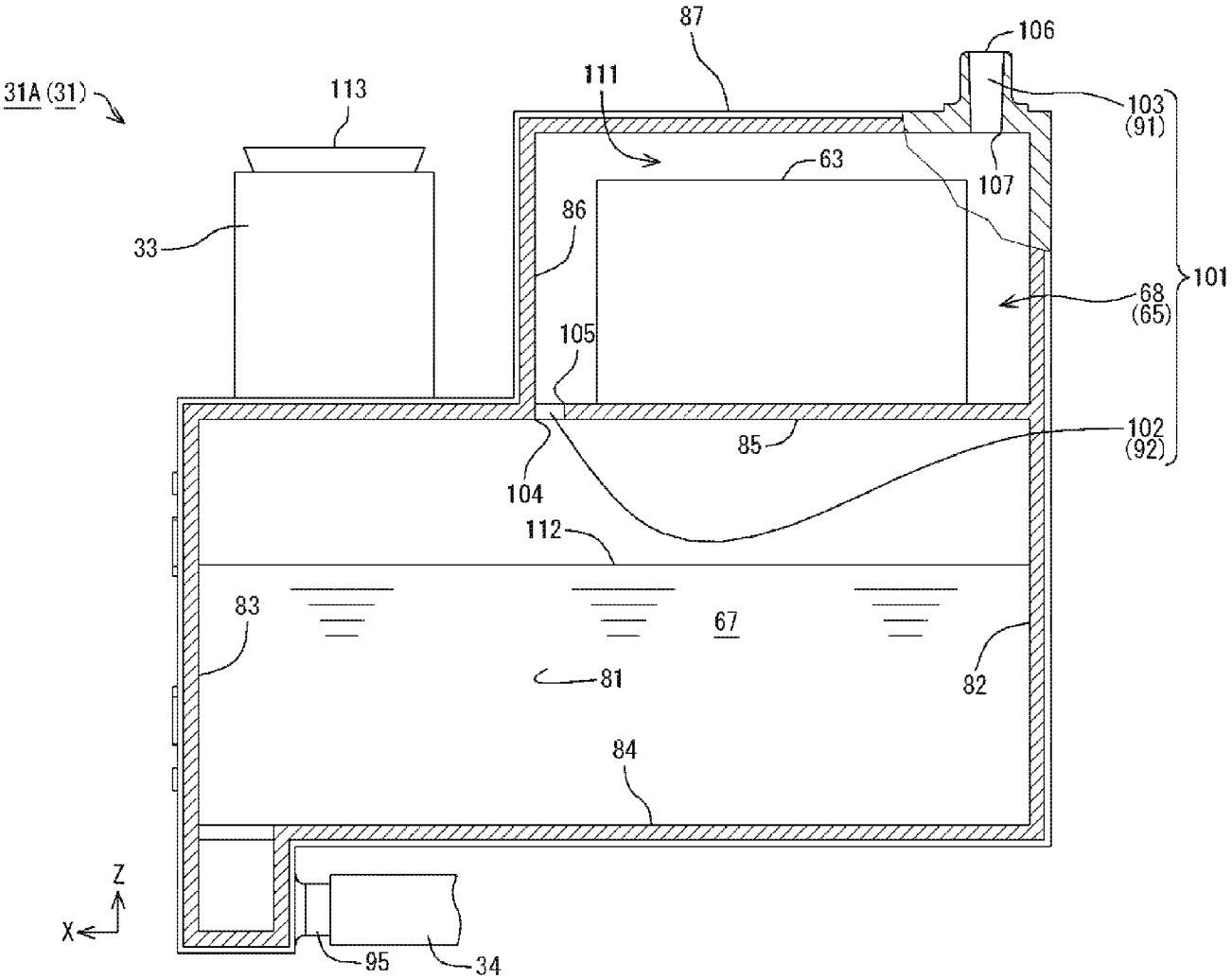
FIG. 5 is a side view of the tank according to Example 1 as viewed from a sheet member side.

The liquid retaining member 63 has, as shown in FIG. 5, a shape smaller than the hollow 65 of the case 61A as viewed planarly in the Y axis direction. In this example, the Z axis dimension (vertical direction) of the liquid retaining member 63 is smaller than the Z axis dimension of the buffer chamber 68. Also, the X axis dimension (horizontal direction) of the liquid retaining member 63 is smaller than the X axis dimension of the buffer chamber 68. Accordingly, within the buffer chamber 68, a gap 111 is formed between the inner wall of the buffer chamber 68 and the liquid retaining member 63.

The gap 111 is provided between the contour surface of the liquid retaining member 63 and the inner wall of the buffer chamber 68. The gap 111 connects between the first communication port 105 and the second communication port 107. In other words, a passage extending from the first communication port 105 through the gap 111 and to the second communication port 107 can be formed. Accordingly, atmospheric air can move between the first communication port 105 and the second communication port 107 through the gap 111 between the contour surface of the liquid retaining member 63 and the inner wall of the buffer chamber 68.

In this example, the liquid retaining member 63 has a shape smaller than the hollow 65 of the case 61A. With this configuration, the gap 111 is provided. However, the method of providing the gap 111 is not limited thereto. As the method of providing the gap 111, for example, it is possible to use a method in which the gap 111 is provided by forming a groove, a through hole, a notch or the like in the liquid retaining member 63. With this method, it is possible to provide the gap 111 even when the shape of the liquid retaining member 63 is set to have the same shape as the hollow 65 of the case 61A or a shape larger than the hollow 65 of the case 61A.

In the tank 31A, as shown in FIG. 5 illustrating a side view of the tank 31A as viewed from the sheet member 62 side, the liquid containing portion 67 contains ink 112. In FIG. 5, for the sake of clarity of the configuration, the sheet member 62 is not illustrated, and the bonding portion 66 is indicated by hatching. The ink 112 contained in the liquid containing portion 67 is supplied to the recording head 19 via the supply inlet 95. In the present embodiment, in a state in which the liquid ejection system 1 is used to perform printing, the ink supply tube 34 is connected to the supply inlet 95, and a cap 113 is attached to the liquid injection portion 33. The cap 113 is an example of a cap member, and is configured to be detachable.

The ink 112 contained in the liquid containing portion 67 is sent to the recording head 19 side along with printing by the recording head 19. Accordingly, along with printing by the recording head 19, the pressure within the liquid containing portion 67 becomes lower than the atmospheric pressure. When the pressure within the liquid containing portion 67 becomes lower than the atmospheric pressure, the atmospheric air in the buffer chamber 68 is sent to the inside of the liquid containing portion 67 through the first atmospheric air communication portion 102. As a result, the pressure within the liquid containing portion 67 is easily maintained at the atmospheric pressure. Atmospheric air flows into the buffer chamber 68 from the second atmospheric air introducing inlet 106 by passing through the second atmospheric air communication portion 103 and the second communication port 107 in this order. With the above-described configuration, the ink 112 contained in the tank 31A is supplied to the recording head 19. When the ink 112 contained in the liquid containing portion 67 of the tank 31A is consumed and the remaining amount of the ink 112 becomes low, the operator can load new ink from the liquid injection portion 33 into the liquid containing portion 67. At this time, the operator injects new ink by detaching the cap 113 from the liquid injection portion 33.

In the tank 31A, even when the orientation of the tank 31A is changed such as, for example, when the liquid ejection system 1 is transported, to cause the ink contained in the liquid containing portion 67 to flow into the atmospheric air introducing portion 101, the ink is likely to remain in the buffer chamber 68. Accordingly, with the tank 31A, the risk of leakage of the ink contained in the liquid containing portion 67 from the second atmospheric air introducing inlet 106 to the outside of the tank 31A can be reduced.

Furthermore, in the tank 31A, the liquid retaining member 63 is housed in the buffer chamber 68, and thus the ink that has flowed into the buffer chamber 68 from the liquid containing portion 67 is likely to be retained by the liquid retaining member 63. Accordingly, even if the ink contained in the liquid containing portion 67 flows into the atmospheric air introducing portion 101, the ink is more likely to remain in the buffer chamber 68.

At this time, if the ink permeates into the liquid retaining member 63, the air permeability of the liquid retaining member 63 becomes extremely low. This is because when a liquid permeates into the liquid retaining member 63, a meniscus is formed by the permeated liquid in the liquid retaining member 63, which makes it difficult for a gas to move. Accordingly, in a state in which the ink has permeated into the liquid retaining member 63, for example, if the gap 111 is not provided in the buffer chamber 68, the airtightness of the liquid containing portion 67 becomes extremely high. If printing is performed by the recording head 19 in this state, a negative pressure state in which the pressure within the liquid containing portion 67 is lower than the atmospheric pressure is likely to persist. In other words, the pressure within the liquid containing portion 67 is unlikely to return from a negative pressure to the atmospheric pressure. If the negative pressure state in the liquid containing portion 67 persists, the ink is unlikely to be supplied to the recording head 19, which is likely to cause a deterioration in the quality of printing.

When the airtightness of the liquid containing portion 67 becomes very high with the ink having permeated into the liquid retaining member 63, and, for example, the pressure within the liquid containing portion 67 increases to a level higher than the atmospheric pressure, the cap 113 is likely to be detached from the liquid injection portion 33. As a result, the ink contained in the liquid containing portion 67 may leak out of the tank 31A from the liquid injection portion 33.

To address the above-described problems, in the tank 31A of this example, the gap 111 is provided within the buffer chamber 68, and thus even in a state in which the ink has permeated into the liquid retaining member 63, atmospheric air can move between the first communication port 105 and the second communication port 107. With this configuration, pressure fluctuations within the liquid containing portion 67 can be reduced. Accordingly, even if the pressure within the liquid containing portion 67 becomes lower than the atmospheric pressure due to printing by the recording head 19, the pressure within the liquid containing portion 67 easily returns to the atmospheric pressure. As a result, it is easy to maintain ink supply to the recording head 19, and thus the quality of printing can be easily maintained at a high level. Also, even if the pressure within the liquid containing portion 67 becomes higher than the atmospheric pressure, the atmospheric air contained in the liquid containing portion 67 can easily flow out of the tank 31A from the atmospheric air introducing portion 101, the pressure within the liquid containing portion 67 easily returns to the atmospheric pressure. Thus, the risk that the cap 113 is detached from the liquid injection portion 33 is easily suppressed. As a result, it is possible to use a detachable cap 113.

Example 2

Figure 6:
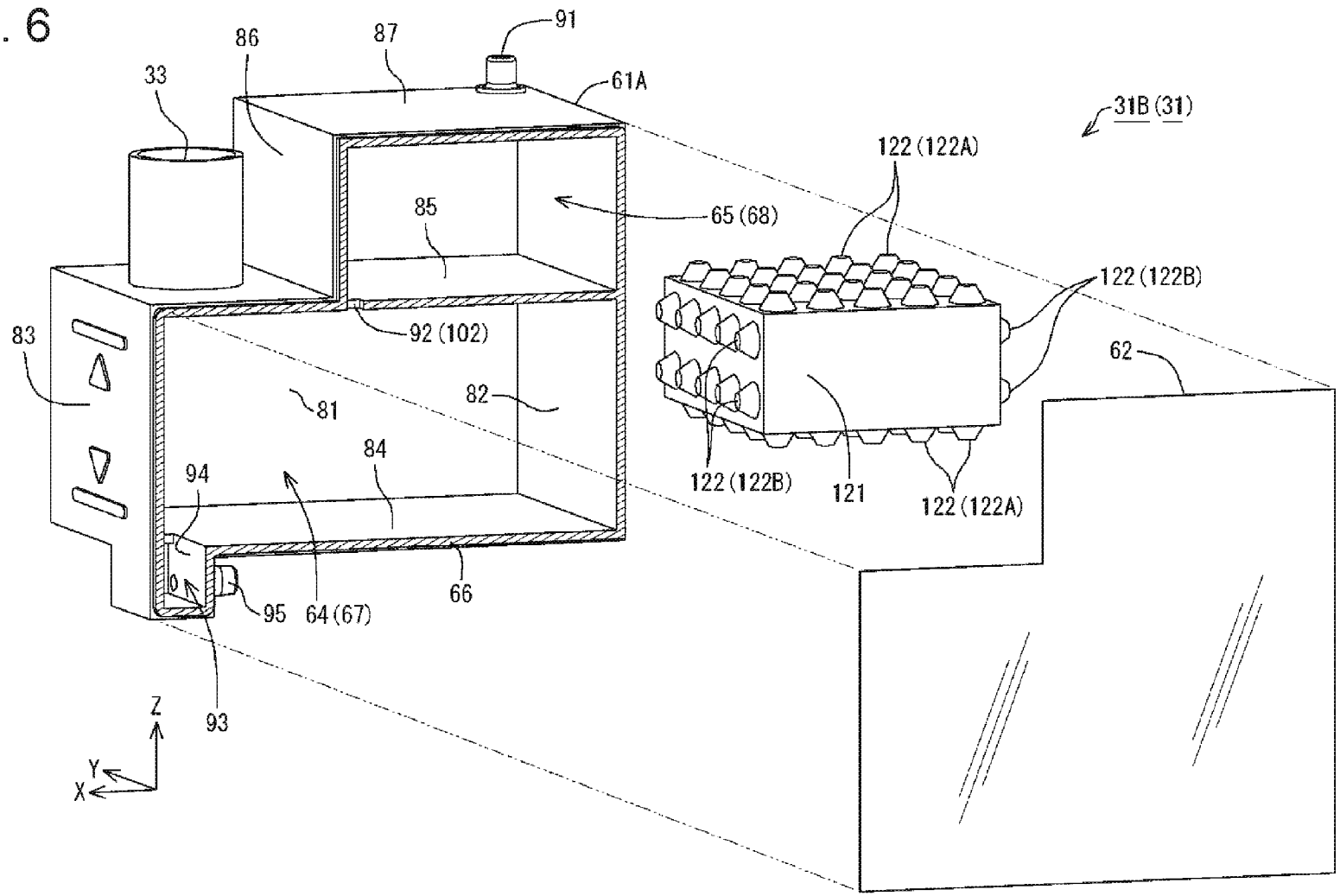
FIG. 6 is an exploded perspective view showing a tank according to Example 2.

A tank 31B of Example 2 includes a liquid retaining member 121 as shown in FIG. 6. The tank 31B of Example 2 has a configuration in which the liquid retaining member 63 of the tank 31A of Example 1 is replaced by the liquid retaining member 121. Other than this point, the tank 31B of Example 2 has the same configuration as that of the tank 31A of Example 1. For this reason, hereinafter, constituent elements similar to those of Example 1 will be given the same reference numerals as those used in Example 1 and a detailed description thereof is omitted here.

The liquid retaining member 121 has a plurality of protrusions 122 provided thereto. The plurality of protrusions 122 protrude from the liquid retaining member 121 toward the inner wall of the buffer chamber 68. A gap 111 is provided by the plurality of protrusions 122 within the buffer chamber 68. The plurality of protrusions 122 include first protrusions 122A protruding along the Z axis (protruding in the vertical direction) and second protrusions 122B protruding along the X axis (protruding in the horizontal direction). In Example 2 as well, the same effects as those of Example 1 can be obtained. In this example, a plurality of first protrusions 122A and a plurality of second protrusions 122B are provided, but the number of first protrusions 122A and the number of second protrusions 122B may be one. The second protrusions 122B may protrude along the Y axis.

Furthermore, in Example 2, a face contact between the inner wall of the buffer chamber 68 and the liquid retaining member 121 can be easily avoided. For example, in a configuration in which the inner wall of the buffer chamber 68 and the liquid retaining member 121 are in face contact with each other, the attraction force between the inner wall and the liquid retaining member 121 into which the liquid has permeated increases, and it is considered that the liquid retaining member 121 is fixed within the buffer chamber 68. At this time, if the liquid retaining member 121 is fixed while covering the first communication port 105, it is difficult for the atmospheric air to move between the first communication port 105 and the second communication port 107. As a result, the pressure within the liquid containing portion 67 is likely to fluctuate significantly. To address this, in the tank 31B of Example 2, due to the presence of the plurality of protrusions 122, the face contact between the inner wall of the buffer chamber 68 and the liquid retaining member 121 can be easily avoided, and thus fluctuations in the pressure within the liquid containing portion 67 can be further reduced.

Example 3

Figure 7:
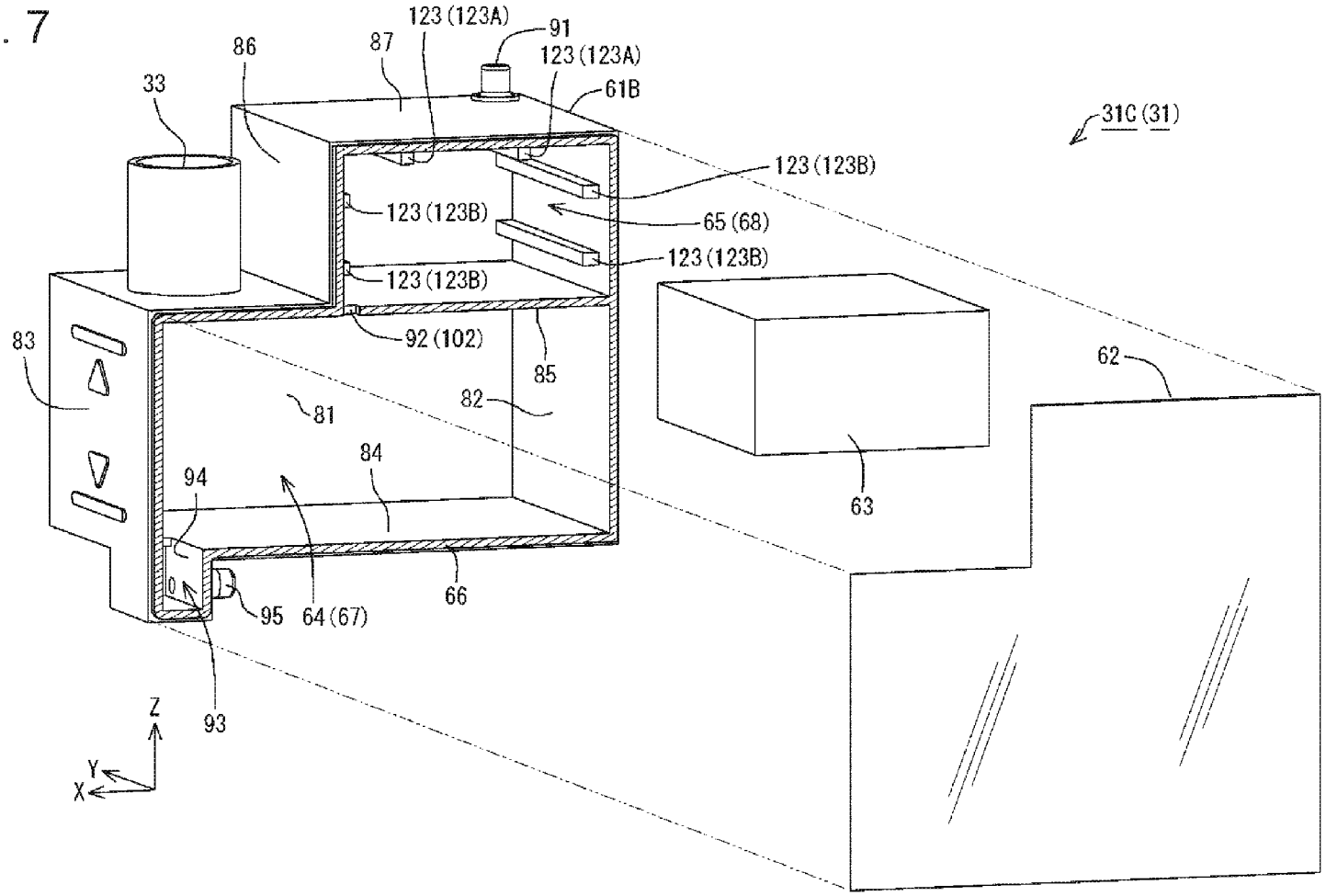
FIG. 7 is an exploded perspective view showing a tank according to Example 3.

A tank 31C of Example 3 includes a case 61B as shown in FIG. 7. The tank 31C of Example 3 has a configuration in which the case 61A of the tank 31A of Example 1 is replaced by the case 61B. Other than this point, the tank 31C of Example 3 has the same configuration as that of the tank 31A of Example 1. For this reason, hereinafter, constituent elements similar to those of Example 1 will be given the same reference numerals as those used in Example 1 and a detailed description thereof is omitted here.

The case 61B has a plurality of protrusions 123 provided thereto. In this example, the plurality of protrusions 123 are configured as ribs formed on the case 61B. The plurality of protrusions 123 protrude from the inner wall of the buffer chamber 68 toward the liquid retaining member 63. A gap 111 is provided by the plurality of protrusions 123 within the buffer chamber 68. The plurality of protrusions 123 include first protrusions 123A protruding along the Z axis (protruding in the vertical direction) and second protrusions 123B protruding along the X axis (protruding in the horizontal direction). In Example 3 as well, the same effects as those of Examples 1 and 2 can be obtained. In this example, a plurality of first protrusions 123A and a plurality of second protrusions 123B are provided, but the number of first protrusions 123A and the number of second protrusions 123B may be one. The second protrusions 123B may protrude along the Y axis from the inner wall of the buffer chamber 68.

Furthermore, in Example 3, even if there are variations in the dimensions of the liquid retaining member 63, the gap 111 can be ensured by the plurality of protrusions 123. With this configuration, fluctuations in the pressure within the liquid containing portion 67 can be further reduced.

Example 4

Figure 8:
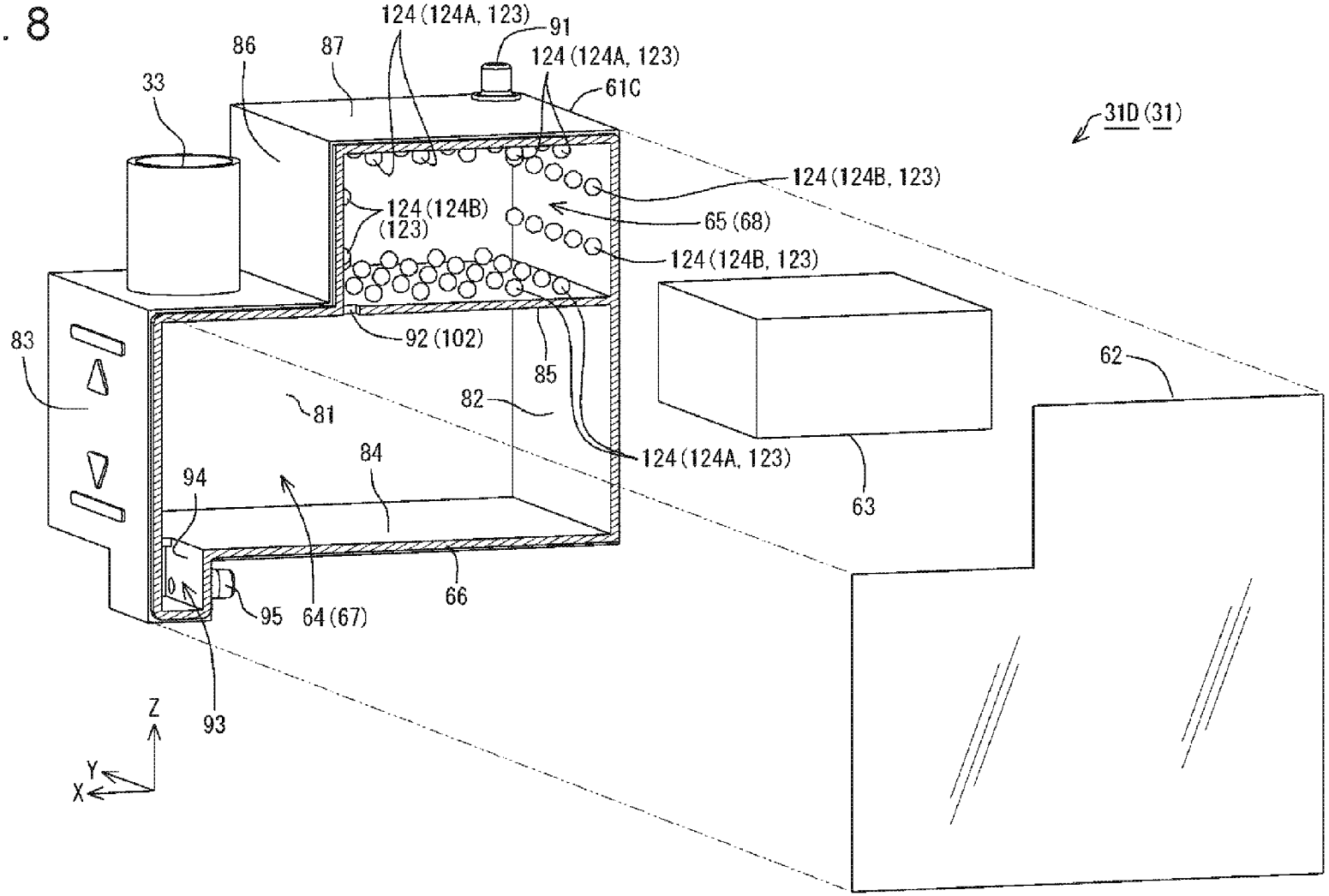
FIG. 8 is an exploded perspective view showing a tank according to Example 4.

In Example 3, the plurality of protrusions 123 are configured as ribs formed on the case 61B. However, the configuration of the plurality of protrusions 123 is not limited thereto. As shown in FIG. 8, as the plurality of protrusions 123, it is possible to use spacers 124 provided on the inner wall of the hollow 65. An example in which the plurality of protrusions 123 are formed by the spacers 124 will be described as Example 4. The spacers 124 are an example of a support member. The spacers 124 are located in a gap 111 between the inner wall of the buffer chamber 68 and the liquid retaining member 63.

As shown in FIG. 8, the tank 31D of Example 4 includes a case 61C. The tank 31D of Example 4 has a configuration in which the case 61A of the tank 31A of Example 1 is replaced by the case 61C. Other than this point, the tank 31D of Example 4 has the same configuration as that of the tank 31A of Example 1. For this reason, hereinafter, constituent elements similar to those of Example 1 will be given the same reference numerals as those used in Example 1 and a detailed description thereof is omitted here.

In this example, the plurality of protrusions 123 are provided by ball-like spacers 124 bonded to the inner wall of the hollow 65. The plurality of spacers 124 include first spacers 124A that are located in the gap 111 extending along the Z axis (the vertical direction) between the inner wall of the buffer chamber 68 and the liquid retaining member 63 and second spacers 124B that are located in the gap 111 extending along the X axis (the horizontal direction) between the inner wall of the buffer chamber 68 and the liquid retaining member 63. In Example 4 as well, the same effects as those of Examples 1 to 3 can be obtained. As the method for bonding the spacers 124 to the inner wall of the hollow 65, various methods can be used such as adhesive bonding, welding and the like.

Example 5

Figure 9:
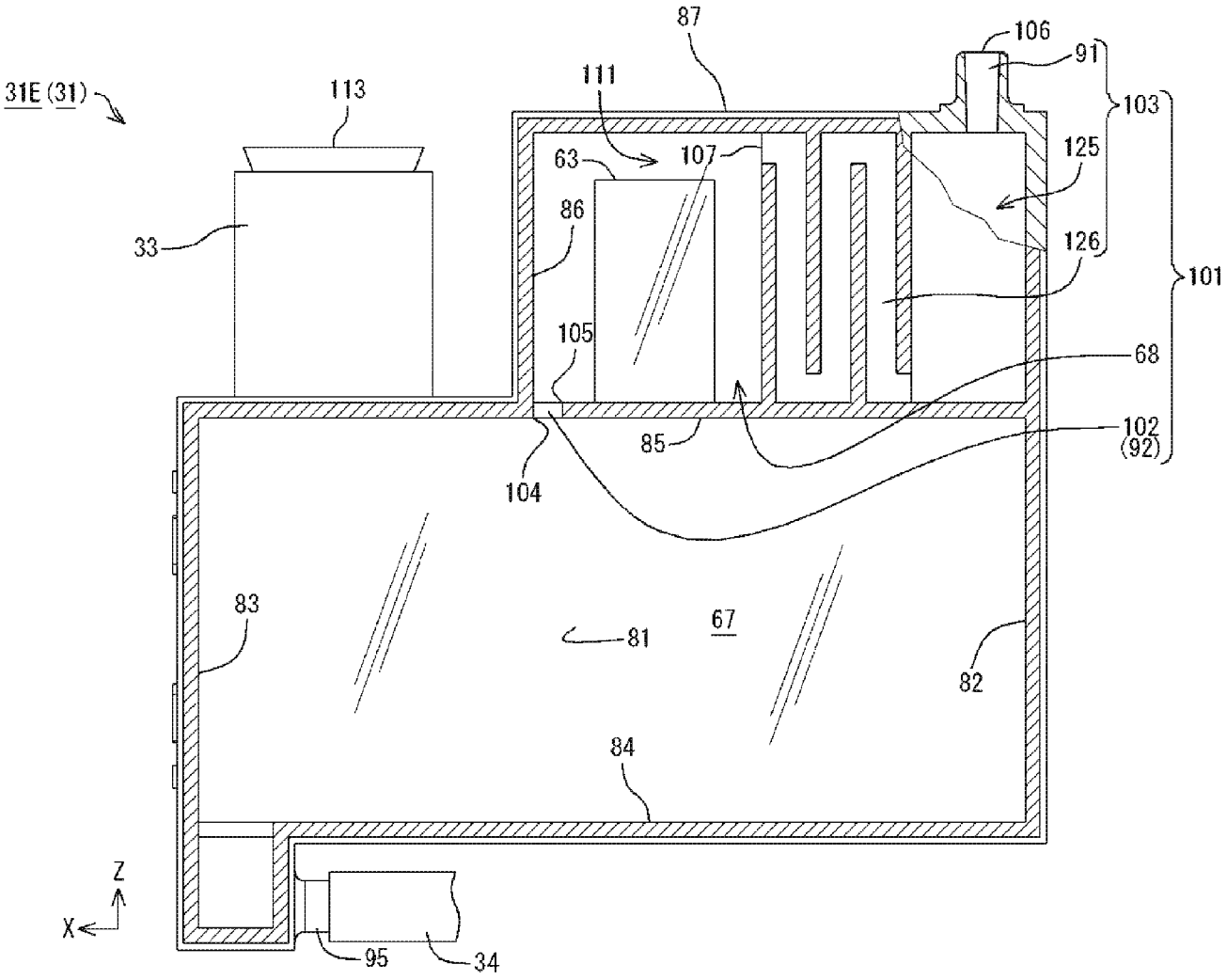
FIG. 9 is a side view of a tank according to Example 5 as viewed from a sheet member side.

In a tank 31E of Example 5, as shown in FIG. 9, an atmospheric air chamber 125 and a communication path 126 are provided between the introducing path 91 and the buffer chamber 68. In other words, in this example, the second atmospheric air communication portion 103 includes the introducing path 91, the atmospheric air chamber 125 and the communication path 126. In the tank 31E of Example 5, the atmospheric air introducing portion 101 has a configuration that is different from that of Examples 1 to 4. Other than this point, the tank 31E of Example 5 has the same configuration as that of the tanks 31 of Examples 1 to 4. For this reason, hereinafter, constituent elements similar to those of Examples 1 to 4 will be given the same reference numerals as those used in Examples 1 to 4 and a detailed description thereof is omitted here.

The configuration in which the atmospheric air chamber 125 and the communication path 126 are provided between the introducing path 91 and the buffer chamber 68 is applicable to each of Examples 1 to 4. In other words, it is possible to use a configuration in which the protrusions 123 (FIG. 7) or the spacers 124 (FIG. 8) are provided to the buffer chamber 68 of the tank 31E.

The atmospheric air chamber 125 is provided between the introducing path 91 and the buffer chamber 68. In the path of the atmospheric air flow channel through which the atmospheric air outside of the tank 31 flows from the second atmospheric air introducing inlet 106 into the liquid containing portion 67, the atmospheric air chamber 125 is located upstream of the buffer chamber 68. The communication path 126 is provided between the atmospheric air chamber 125 and the buffer chamber 68. In the path of the atmospheric air flow channel, the communication path 126 is located at a position that is downstream of the atmospheric air chamber 125 and upstream of the buffer chamber 68. The communication path 126 communicates between the atmospheric air chamber 125 and the buffer chamber 68. The communication path 126 is meandered. The atmospheric air chamber 125 is meandered via the communication path 126 and communicates with the buffer chamber 68. As the configuration of the communication path 126, it is possible to use a configuration in which the communication path 126 is not meandered.

In Example 5 as well, the same effects as those of Examples 1 to 4 can be obtained. Furthermore, in Example 5, the communication path 126 and the atmospheric air chamber 125 are provided upstream of the buffer chamber 68, and thus the risk of leakage of the ink contained in the liquid containing portion 67 from the second atmospheric air introducing inlet 106 to the outside of the tank 31 can be further reduced.

Example 6

Figure 10:
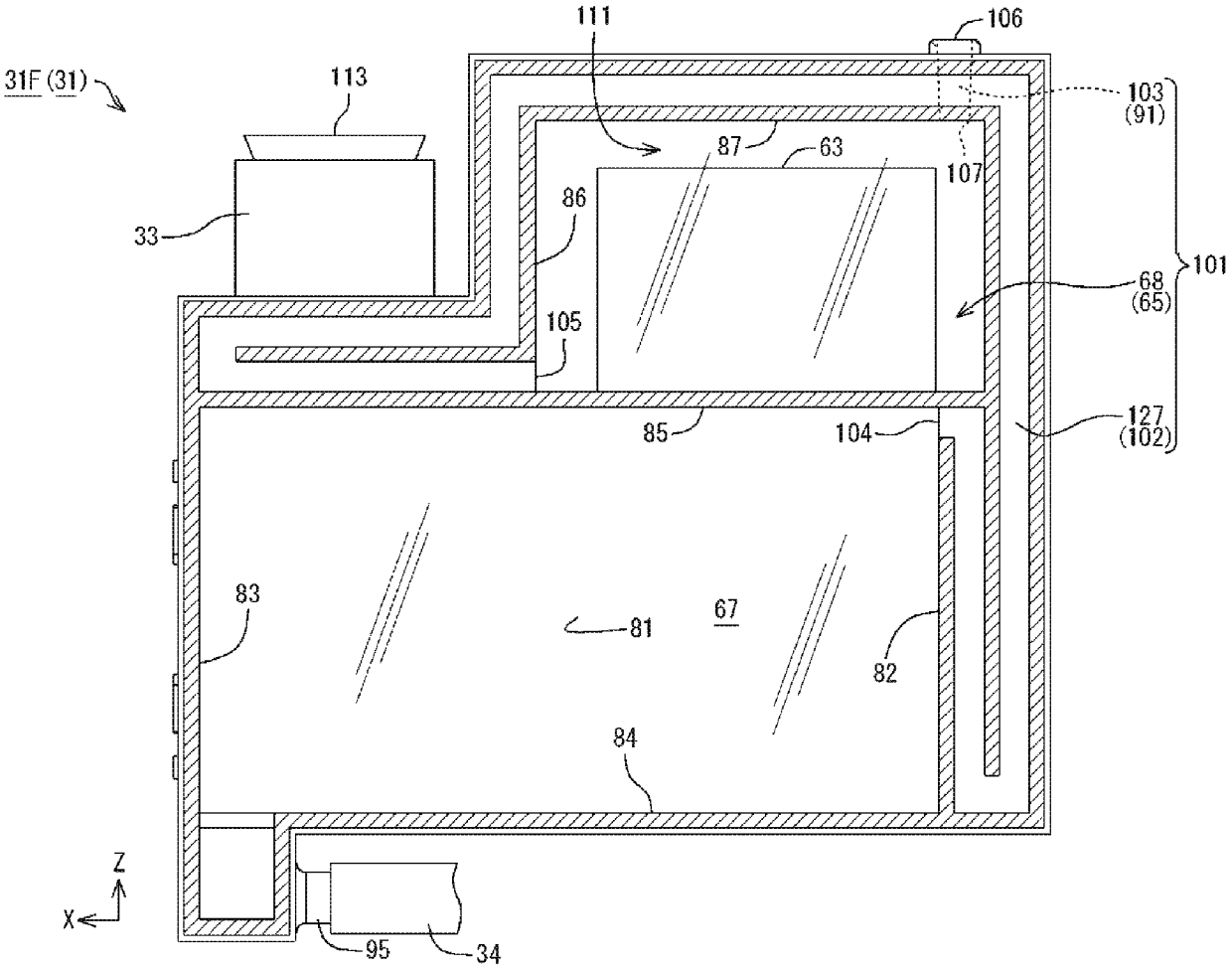
FIG. 10 is a side view of a tank according to Example 6 as viewed from a sheet member side.

In a tank 31F of Example 6, as shown in FIG. 10, a communication path 127 is provided between the buffer chamber 68 and the liquid containing portion 67. In other words, in this example, the first atmospheric air communication portion 102 includes the communication path 127. In the tank 31F of Example 6, the atmospheric air introducing portion 101 has a configuration different from that of Examples 1 to 5. Other than this point, the tank 31F of Example 6 has the same configuration as that of the tank 31 of Examples 1 to 5. For this reason, hereinafter, constituent elements similar to those of Examples 1 to 5 will be given the same reference numerals as those used in Examples 1 to 5 and a detailed description thereof is omitted here.

The configuration in which the communication path 127 is provided between the buffer chamber 68 and the liquid containing portion 67 is applicable to each of Examples 1 to 5. In other words, it is possible to use a configuration in which the protrusions 123 (FIG. 7) or the spacers 124 (FIG. 8) are provided to the buffer chamber 68 of the tank 31F.

The communication path 127 is provided between the buffer chamber 68 and the liquid containing portion 67. In the path of the atmospheric air flow channel through which the atmospheric air outside of the tank 31 flows from the second atmospheric air introducing inlet 106 into the liquid containing portion 67, the communication path 127 is located downstream of the buffer chamber 68. The communication path 127 communicates between the buffer chamber 68 and the liquid containing portion 67. The communication path 127 is meandered. The buffer chamber 68 is meandered via the communication path 127 and communicates with the liquid containing portion 67. As the configuration of the communication path 127, it is possible to use a configuration in which the communication path 127 is not meandered.

In Example 6 as well, the same effects as those of Examples 1 to 5 can be obtained. Furthermore, in Example 6, the communication path 127 is provided downstream of the buffer chamber 68, and thus the risk of leakage of the ink contained in the liquid containing portion 67 from the second atmospheric air introducing inlet 106 to the outside of the tank 31 can be further reduced.

Example 7

Figure 11:
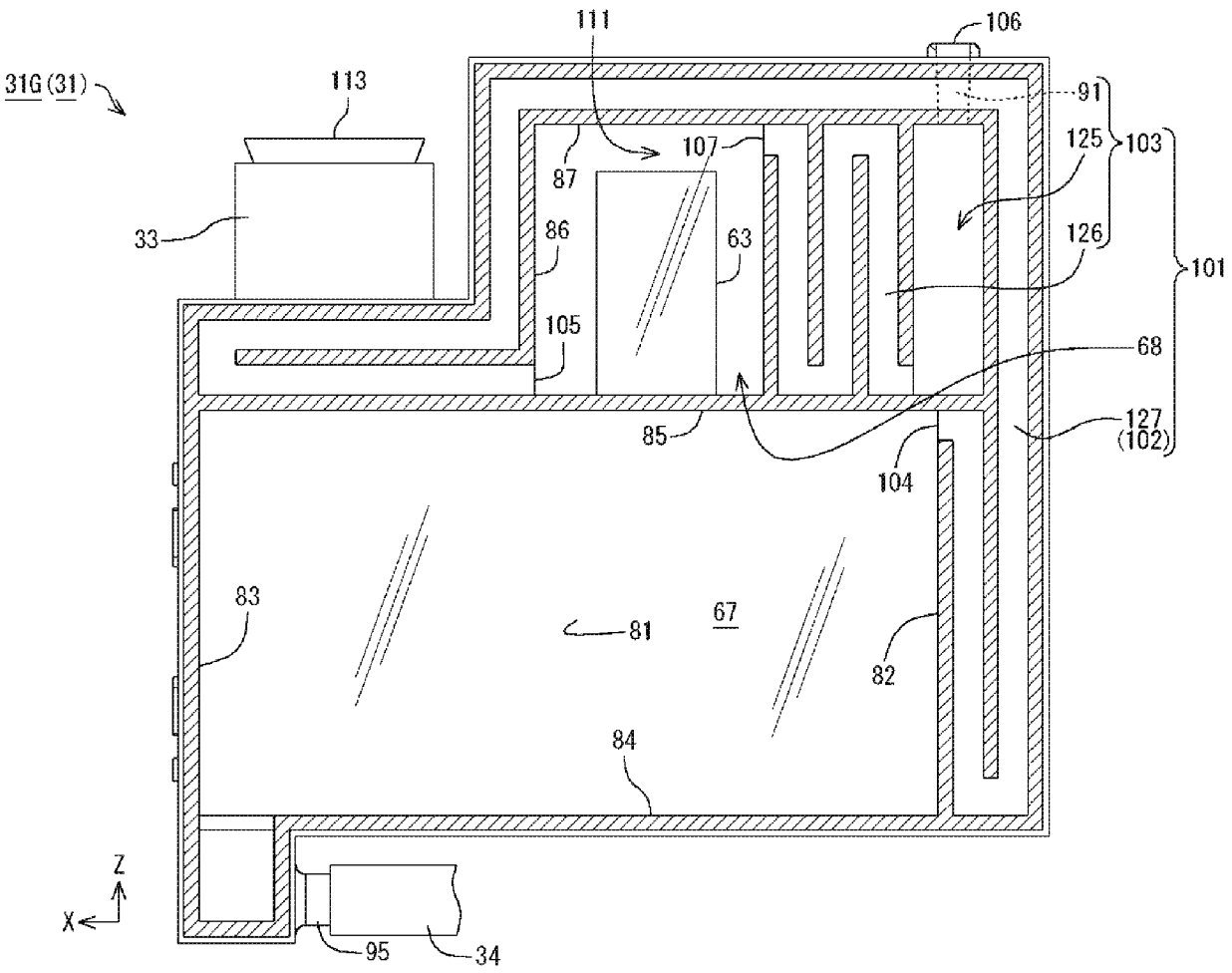
FIG. 11 is a side view of a tank according to Example 7 as viewed from a sheet member side.

In a tank 31G of Example 7, as shown in FIG. 11, an atmospheric air chamber 125 and a communication path 126 are provided between the introducing path 91 and the buffer chamber 68, and a communication path 127 is provided between the buffer chamber 68 and the liquid containing portion 67. In other words, in this example, the second atmospheric air communication portion 103 includes the introducing path 91, the atmospheric air chamber 125 and the communication path 126, and the first atmospheric air communication portion 102 includes the communication path 127. In the tank 31G of Example 7, the atmospheric air introducing portion 101 has a configuration different from that of Examples 1 to 6. Other than this point, the tank 31G of Example 7 has the same configuration as that of the tank 31 of Examples 1 to 6. For this reason, hereinafter, constituent elements similar to those of Examples 1 to 6 will be given the same reference numerals as those used in Examples 1 to 6 and a detailed description thereof is omitted here.

The configuration in which the atmospheric air chamber 125 and the communication path 126 are provided between the introducing path 91 and the buffer chamber 68 and the communication path 127 is provided between the buffer chamber 68 and the liquid containing portion 67 is applicable to each of Examples 1 to 6. In other words, it is possible to use a configuration in which the protrusions 123 (FIG. 7) or the spacers 124 (FIG. 8) are provided to the buffer chamber 68 of the tank 31G.

In Example 7 as well, the same effects as those of Examples 1 to 6 can be obtained. Furthermore, in Example 7, the communication path 126 and the atmospheric air chamber 125 are provided upstream of the buffer chamber 68 and the communication path 127 is provided downstream of the buffer chamber 68, and thus the risk of leakage of the ink contained in the liquid containing portion 67 from the second atmospheric air introducing inlet 106 to the outside of the tank 31 can be further reduced.

Example 8

Figure 12:
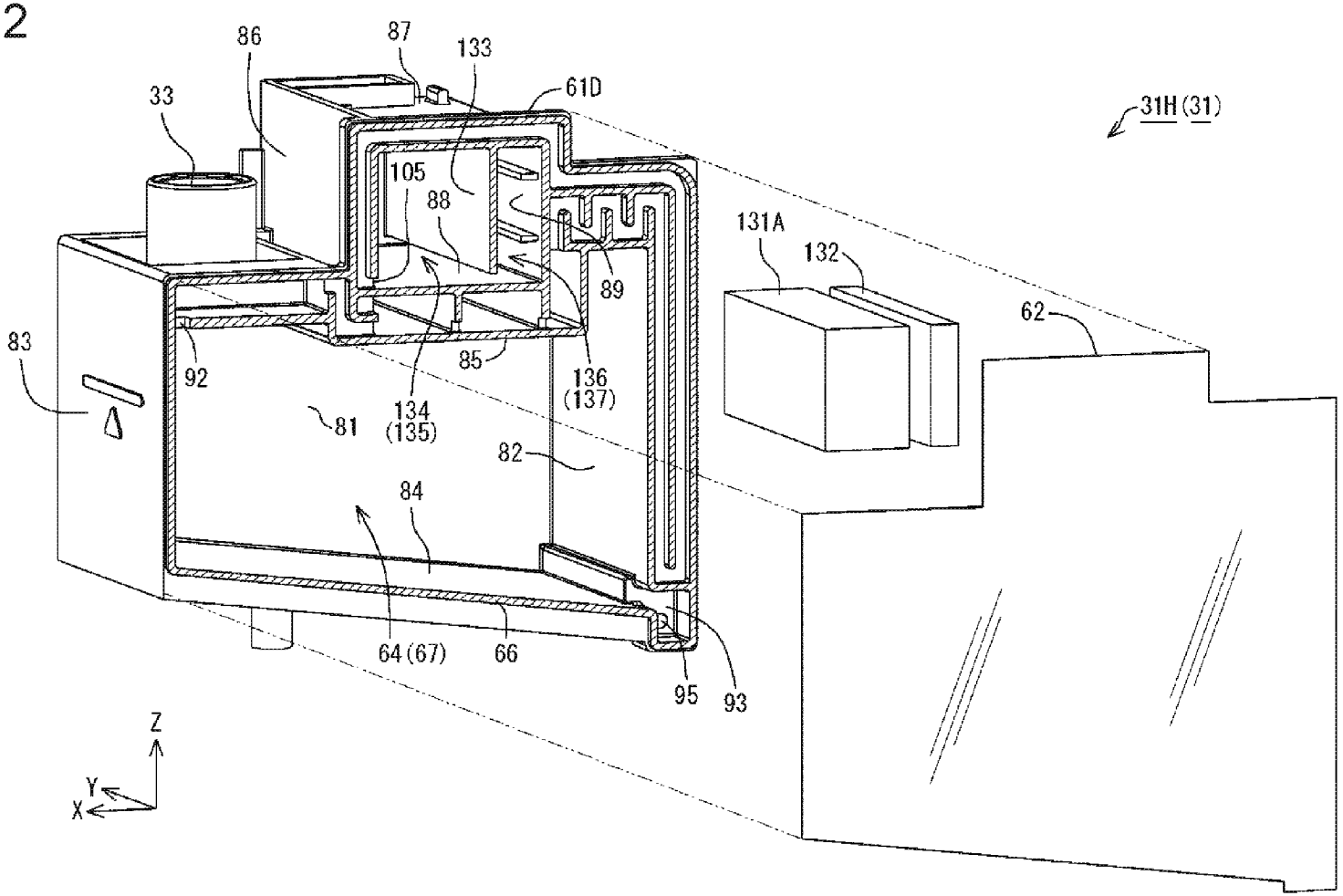
FIG. 12 is an exploded perspective view showing a tank according to Example 8.

A tank 31H of Example 8 includes, as shown in FIG. 12, a case 61D, a sheet member 62, a first liquid retaining member 131A and a second liquid retaining member 132. Of the constituent elements of Example 8, those having the same functions as the constituent elements of Examples 1 to 7 will be given the same reference numerals as those of Examples 1 to 7, and a detailed description is omitted.

The case 61D includes an eighth wall 88 and a ninth wall 89. The first to seventh walls 81 to 87 of the case 61D have the same functions as the first to seventh walls 81 to 87 of Examples 1 to 7. The eighth wall 88 is provided between the fifth wall 85 and the seventh wall 87. The eighth wall 88 extends along the XY plane and is located opposite to the fifth wall 85 and to the seventh wall 87. The ninth wall 89 is provided between the sixth wall 86 and the second wall 82. The ninth wall 89 extends along the YZ plane and is located opposite to the second wall 82 and to the sixth wall 86. Also, a partition wall 133 extending along the YZ plane is provided between the sixth wall 86 and the ninth wall 89. The partition wall 133 is located opposite to the sixth wall 86 and to the ninth wall 89.

The eighth wall 88, the ninth wall 89 and the partition wall 133 protrude in the −Y axis direction from the first wall 81. As a result, a hollow 134 is constituted by, with the first wall 81 being defined as the main wall, the sixth wall 86, the seventh wall 87, the eighth wall 88 and the partition wall 133 that extend in the −Y axis direction from the main wall. The hollow 134 is configured so as to form a recess extending toward the Y axis direction. As a result of the sheet member 62 being bonded to the case 61D, the hollow 134 is closed by the sheet member 62, and thereby a first buffer chamber 135 is formed. Then, the first liquid retaining member 131A is housed in the first buffer chamber 135.

Also, a hollow 136 is constituted by, with the first wall 81 defined as the main wall, the seventh wall 87, the eighth wall 88, the ninth wall 89 and the partition wall 133 that extend in the −Y axis direction from the main wall. The hollow 136 is configured so as to form a recess extending toward the Y axis direction. As a result of the sheet member 62 being bonded to the case 61D, the hollow 136 is closed by the sheet member 62 and thereby a second buffer chamber 137 is formed. Then, the second liquid retaining member 132 is housed in the second buffer chamber 137. As the material for the first liquid retaining member 131A and the second liquid retaining member 132, the same material as that of the liquid retaining member 63 of Example 1 can be used. Also, the first liquid retaining member 131A and the second liquid retaining member 132 have the same function as the liquid retaining member 63.

The volume of the first buffer chamber 135 is larger than that of the second buffer chamber 137. For this reason, the volume of the first liquid retaining member 131A is larger than that of the second liquid retaining member 132. The first buffer chamber 135 and the second buffer chamber 137 have the same function as the buffer chamber 68 of Example 1. In the path of the atmospheric air flow channel through which the atmospheric air outside of the tank 31 flows from the second atmospheric air introducing inlet 106 (not shown in FIG. 12) into the liquid containing portion 67, the atmospheric air chamber 125 is located upstream of the first buffer chamber 135 and the second buffer chamber 137.

Figure 13:
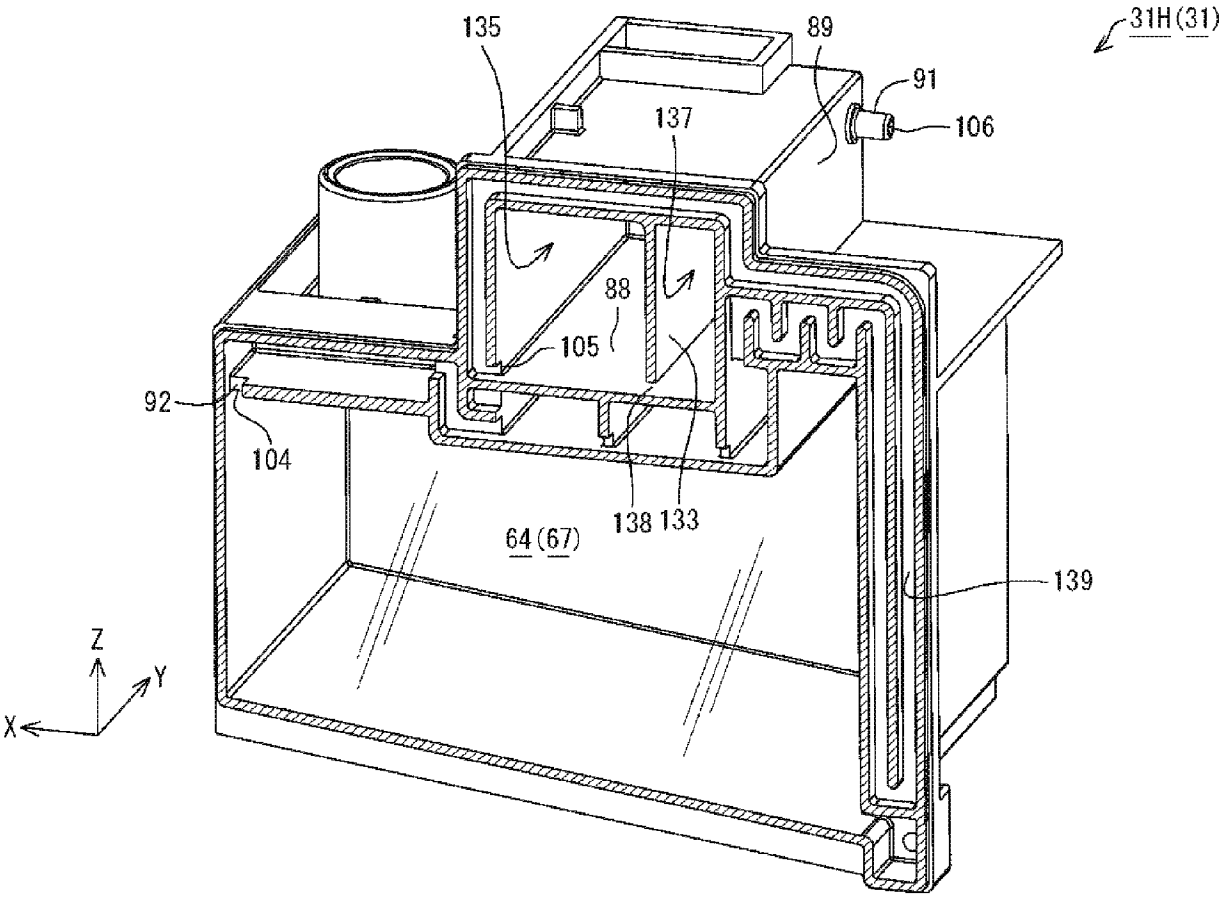
FIG. 13 is a perspective view showing a case according to Example 8.

In this example, as shown in FIG. 13, an introducing path 91 is provided on the ninth wall 89. The introducing path 91 protrudes in the −X axis direction from the ninth wall 89. The introducing path 91 communicates with the second buffer chamber 137 by penetrating through the ninth wall 89. A communication portion 138 is provided between the partition wall 133 and the eighth wall 88. In this example, the communication portion 138 is configured as a gap provided between the partition wall 133 and the eighth wall 88. The first buffer chamber 135 and the second buffer chamber 137 communicate with each other via the communication portion 138.

In this example, a communication path 139 is present between the first buffer chamber 135 and the liquid containing portion 67. The communication path 139 is provided between the first buffer chamber 135 and the liquid containing portion 67. In the path of the atmospheric air flow channel through which the atmospheric air outside of the tank 31 flows from the second atmospheric air introducing inlet 106 into the liquid containing portion 67, the communication path 139 is located downstream of the first buffer chamber 135. The communication path 139 communicates between the first buffer chamber 135 and the liquid containing portion 67. The communication path 139 is meandered. The first buffer chamber 135 is meandered via the communication path 139 and communicates with the liquid containing portion 67. Accordingly, the atmospheric air outside of the tank 31 can enter from the second atmospheric air introducing inlet 106, pass through the second buffer chamber 137, the first buffer chamber 135 and the communication path 139 in this order, and flow into the liquid containing portion 67 through the first atmospheric air introducing inlet 104. As the configuration of the communication path 139, it is possible to use a configuration in which the communication path 139 is not meandered.

Figure 14:
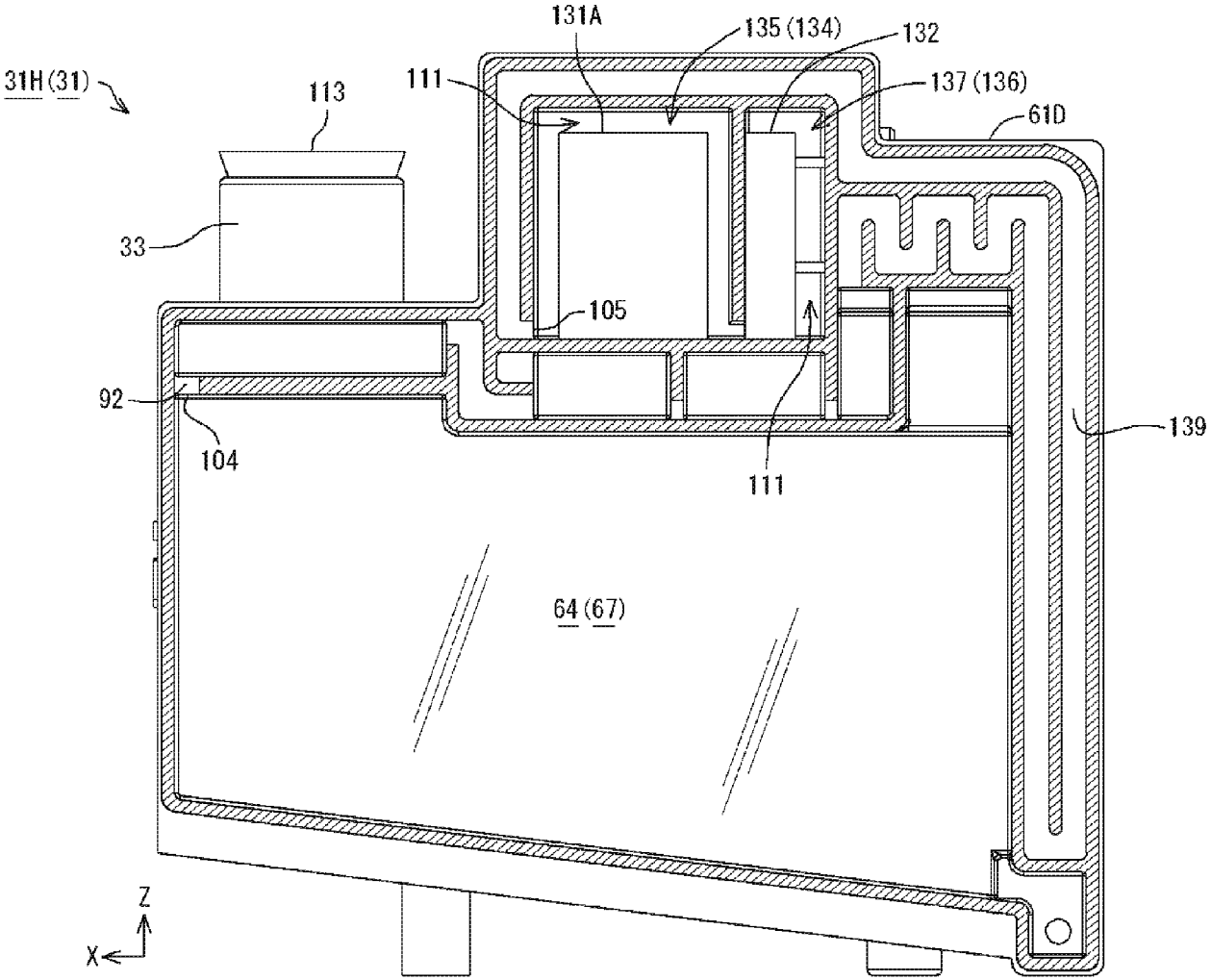
FIG. 14 is a side view of the tank according to Example 8 as viewed from a sheet member side.

As shown in FIG. 14, the first liquid retaining member 131A has a shape smaller than the hollow 134 of the case 61D, as viewed planarly in the Y axis direction. In this example, the Z axis dimension (vertical direction) of the first liquid retaining member 131A is smaller than the Z axis dimension of the first buffer chamber 135. Also, the X axis dimension (horizontal direction) of the first liquid retaining member 131A is smaller than the X axis dimension of the first buffer chamber 135. Accordingly, within the first buffer chamber 135, a gap 111 is provided between the inner wall of the first buffer chamber 135 and the first liquid retaining member 131A.

The second liquid retaining member 132 has a shape smaller than the hollow 136 of the case 61D, as viewed planarly in the Y axis direction. In this example, the Z axis dimension (vertical direction) of the second liquid retaining member 132 is smaller than the Z axis dimension of the second buffer chamber 137. Also, the X axis dimension (horizontal direction) of the second liquid retaining member 132 is smaller than the X axis dimension of the second buffer chamber 137. Accordingly, within the second buffer chamber 137, a gap 111 is provided between the inner wall of the second buffer chamber 137 and the second liquid retaining member 132.

The method of providing the gap 111 is not limited to those described above. As the method of providing the gap 111, it is possible to, for example, use a method in which the gap 111 is provided by forming a groove, a through hole, a notch or the like in the first liquid retaining member 131A or the second liquid retaining member 132. With this method, the gap 111 can be provided even when the shape of the first liquid retaining member 131A is set to be the same as that of the hollow 134 of the case 61D or larger than that of the hollow 134 of the case 61D. Also, with this method, the gap 111 can also be provided even when the shape of the second liquid retaining member 132 is set to be the same as that of the hollow 136 of the case 61D or larger than that of the hollow 136 of the case 61D.

The gap 111 has the same function as the gap 111 of Examples 1 to 7. In Example 8 as well, the same effects as those of Examples 1 to 7 can be obtained.

Example 9

Figure 15:
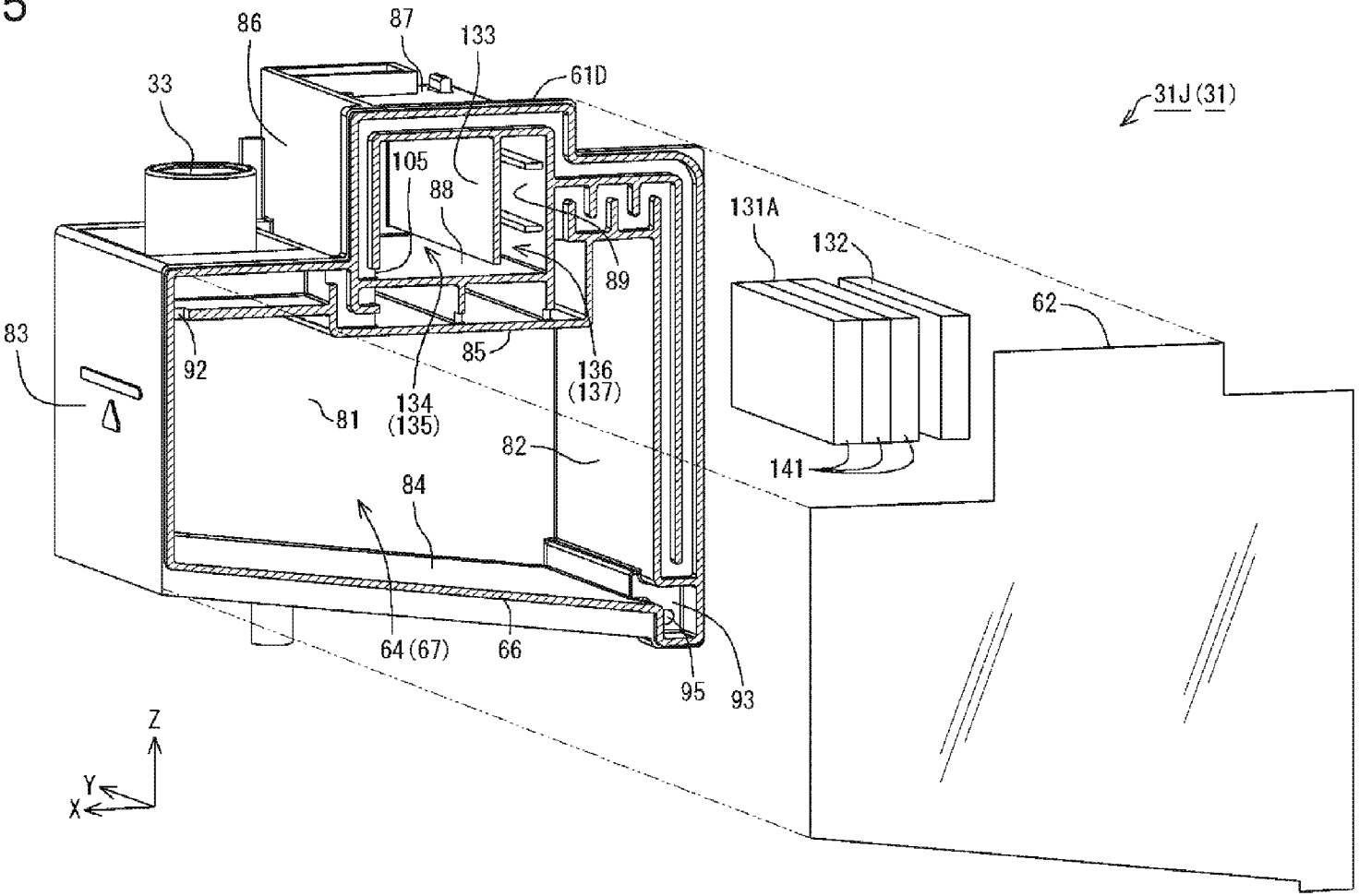
FIG. 15 is an exploded perspective view showing a tank according to Example 9.

In a tank 31J of Example 9, as shown in FIG. 15, the first liquid retaining member 131A is constituted by a plurality of members 141 (three members 141 in the example shown in FIG. 15). Other than this point, the tank 31J has the same configuration as that of the tank 31H of Example 8. For this reason, hereinafter, constituent elements similar to those of Example 8 will be given the same reference numerals as those used in Example 8 and a detailed description thereof is omitted here.

A member 141 has a plate-like outer shape. The member 141 is an example of a plate-like member. A plurality of members 141 are brought together in a bundle to constitute the first liquid retaining member 131A. It is also possible to use a configuration in which a plurality of members 141 are separately housed in the first buffer chamber 135. As the method for bringing the plurality of members 141 together in a bundle, various methods can be used such as for example, a method in which the plurality of members 141 are bundled by bonding them together, or by using a binding member.

In Example 9 as well, the same effects as those of Example 8 can be obtained. Also, in Example 9, the first liquid retaining member 131A that can fit into the first buffer chamber 135 of a different size is easily configured by adjusting the number of members 141 constituting the first liquid retaining member 131A. With this configuration, the members 141 can be used commonly in first liquid retaining members 131A of various sizes. As a result, the cost for the first liquid retaining member 131A can be easily reduced.

In this example, the size of the members 141 is set to be equal to that of the second liquid retaining member 132. In other words, the second liquid retaining member 132 is constituted by one member 141. With this configuration, the members 141 can be used commonly in the first buffer chamber 135 and the second buffer chamber 137. As a result, the cost for the first liquid retaining member 131A and the second liquid retaining member 132 can be easily reduced.

Example 10

Figure 16:
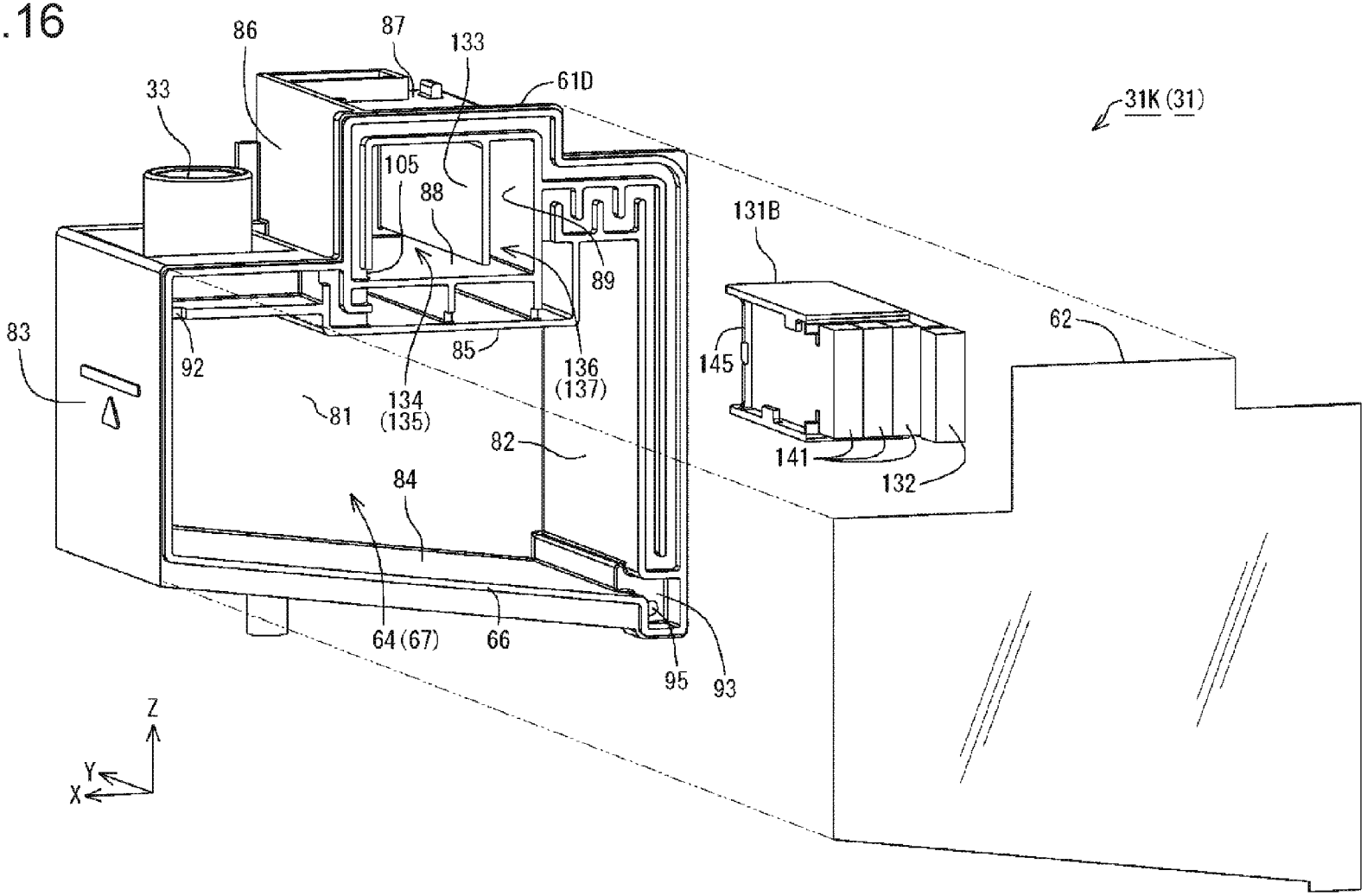
FIG. 16 is an exploded perspective view showing a tank according to Example 10.

As shown in FIG. 16, a tank 31K of Example 10 includes a first liquid retaining member 131B. The tank 31K has a configuration in which the first liquid retaining member 131A of the tank 31J of Example 9 is replaced by the first liquid retaining member 131B. Other than this point, the tank 31K of Example 10 has the same configuration as that of the tank 31J of Example 9. For this reason, hereinafter, constituent elements similar to those of Example 9 will be given the same reference numerals as those used in Example 9 and a detailed description thereof is omitted here.

Figure 17:
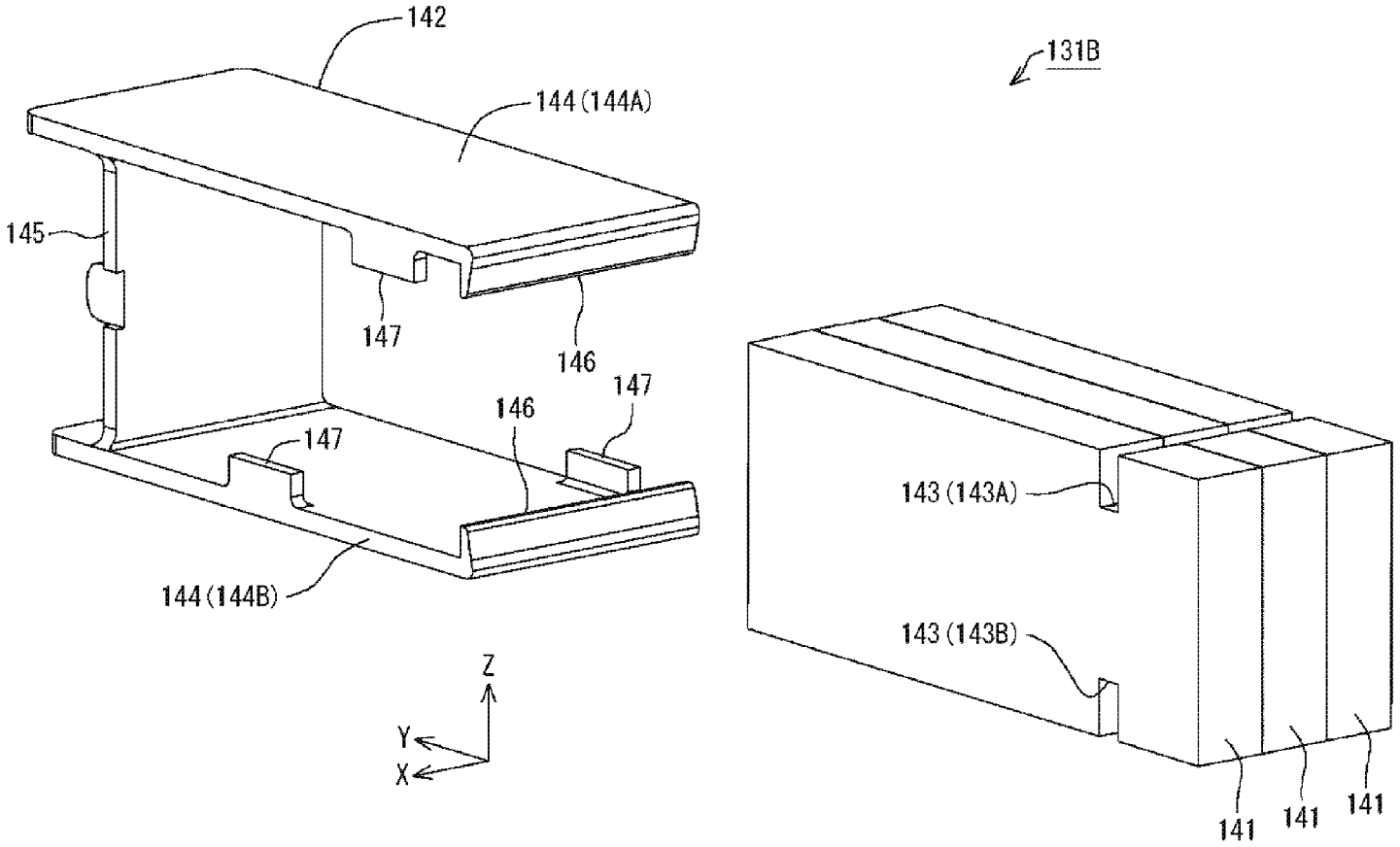
FIG. 17 is an exploded perspective view showing a first liquid retaining member according to Example 10.

The first liquid retaining member 131B includes, as shown in FIG. 17, a plurality of members 141 and a clip 142. The members 141 are similar to the members 141 of Example 9, and thus a detailed description is omitted here. In the first liquid retaining member 131B of this example, the plurality of members 141 are bundled by the clip 142, which is an example of the binding member. Grooves 143 are formed in the members 141. In the members 141, the grooves 143 are formed in the surface facing toward the Z axis direction and in the surface facing toward the −Z axis direction. Hereinafter, the groove 143 formed in the surface facing toward the Z axis direction of the members 141 will also be referred to as "groove 143A". Likewise, the groove 143 formed in the surface facing toward the −Z axis direction of the members 141 will also be referred to as "groove 143B".

The clip 142 includes a pair of arm portions 144 and a connection portion 145. The pair of arm portions 144 each extend along the XY plane. The pair of arm portions 144 are located opposite to each other along the Z axis with a gap therebetween. Hereinafter, one of the pair of arm portions 144 that is located in the Z axis direction will also be referred to as "arm portion 144A". Likewise, the other one of the pair of arm portions 144 that is located in the −Z axis direction will also be referred to as "arm portion 144B". Each of the pair of arm portions 144 has a claw portion 146 provided at one end thereof in the −Y axis direction. In the pair of arm portions 144, the claw portions 146 are provided on the surfaces that are located opposite to each other. The claw portion 146 of the arm portion 144A protrudes in the −Z axis direction. The claw portion 146 of the arm portion 144B protrudes in the Z axis direction.

Also, in each of the pair of arm portions 144, claw portions 147 are respectively provided at one end thereof in the X axis direction and the other end thereof in the −X axis direction. In the pair of arm portions 144, the claw portions 147 are provided on the surfaces that are located opposite to each other. The claw portions 147 of the arm portion 144A protrude in the −Z axis direction. The claw portions 147 of the arm portion 144B protrude in the Z axis direction.

The connection portion 145 is provided between the pair of arm portions 144. The connection portion 145 is provided at the other end, which is opposite to the one end at which the claw portions 146 of the pair of arm portions 144 are provided. The connection portion 145 extends along the XZ plane. The pair of arm portions 144 protrude farther than the connection portion 145 in the Y axis direction.

The plurality of members 141 are sandwiched between the arm portion 144A and the arm portion 144B. At this time, the claw portion 146 of the arm portion 144A is inserted into the groove 143A of the members 141, and the claw portion 146 of the arm portion 144B is inserted into the groove 143B of the members 141. With this configuration, it is possible to prevent the members 141 from being detached in the −Y axis direction from the clip 142.

The claw portions 147 are located on the outer sides of the width, which is along the X axis, of the plurality of members 141. For this reason, the claw portions 147 can prevent, when the plurality of members 141 are sandwiched between the arm portion 144A and the arm portion 144B, the plurality of members 141 from being detached in the X axis direction and the −X axis direction.

As shown in FIG. 16, the first liquid retaining member 131B having the above-described configuration is housed in the hollow 134 of the case 61D from the connection portion 145 side. At this time, as described above, in the first liquid retaining member 131B, the pair of arm portions 144 protrude farther than the connection portion 145 in the Y axis direction, and thus a gap 111 is provided between the connection portion 145 and the first wall 81, which is the bottom of the hollow 134. With this configuration, in Example 10 as well, the same effects as those of Examples 8 and 9 can be obtained. Furthermore, in Example 10, the plurality of members 141 are bundled by the clip 142, and thus troublesome tasks of handling the first liquid retaining member 131B can be reduced.

Example 11

In a tank 31L of Example 11 (not shown), the plurality of protrusions 122 of Example 2 (FIG. 6) are provided to the first liquid retaining member 131A of Example 8. Other than this point, the tank 31L of Example 11 has the same configuration as that of the tank 31H of Example 8. For this reason, hereinafter, constituent elements similar to those of Example 8 will be given the same reference numerals as those used in Example 8 and a detailed description thereof is omitted here.

In Example 11 as well, as in Example 8, a gap 111 can be provided by the plurality of protrusions 122 within the first buffer chamber 135. Also, in Example 11 as well, as in Example 2, the face contact between the inner wall of the first buffer chamber 135 and the first liquid retaining member 131A can be easily avoided.

Example 12

In Examples 8 and 9, it is possible to use a configuration in which the protrusions 123 (FIG. 7) of Example 3 or the spacers 124 (FIG. 8) of Example 4 are provided to the first buffer chamber 135 and the second buffer chamber 137. A tank 31M (not shown) in which the protrusions 123 (FIG. 7) of Example 3 or the spacers 124 (FIG. 8) of Example 4 are provided to the first buffer chamber 135 and the second buffer chamber 137 will be referred to as Example 12. In Example 12 as well, the same effects as those of Example 8 or 9 can be obtained.

In the embodiments described above, the liquid ejection apparatus may be a liquid ejection apparatus that consumes a liquid other than ink by ejecting, discharging or applying the liquid. The liquid discharged from the liquid ejection apparatus in the form of micro-droplets can be in the shape of granules, teardrops or long strings. Also, the liquid as used herein can be any material, as long as it can be consumed by the liquid ejection apparatus. As the liquid, for example, a substance in a liquid phase can be used, and examples include liquids having a high or low viscosity and fluids such as sol, gel water, other inorganic solvents, organic solvents, solutions, liquid resins and liquid metals (metal melts). The liquid also encompasses not only a liquid which is one of the states of a substance, but also a liquid in which functional material particles made of a solid such as a pigment or metal particles are dissolved, dispersed or mixed in a solvent, and the like. Typical examples of the liquid include, in addition to the ink described in the embodiments above, a liquid crystal, and the like. The ink as used herein encompasses commonly used water-based ink, oil-based ink and various liquid compositions such as gel ink and hot melt ink. Specific examples of the liquid ejection apparatus include liquid ejection apparatuses that eject a liquid containing a material such as an electrode material or a coloring material being dispersed or dissolved therein, which is used to manufacture a liquid crystal display, an EL (electroluminescent) display, a surface-emitting display or a color filter. It is also possible to use, for example, a liquid ejection apparatus that ejects a biological organic substance used to manufacture biochips, a liquid ejection apparatus that ejects a sample liquid and is used as a precision pipette, a textile printing apparatus, and a micro-dispenser. Furthermore, it is also possible to use a liquid ejection apparatus that ejects a lubricating oil to a precision instrument such as a clock or a camera with a pin-point accuracy, and a liquid ejection apparatus that ejects a transparent resin solution such as UV curable resin onto a substrate so as to form a micro hemispherical lens (optical lens) or the like for use in an optical communication device or the like. It is also possible to use a liquid ejection apparatus that ejects an acidic or alkaline etching solution so as to etch a substrate or the like.

It should be noted that the invention is not limited to the embodiment and examples described above, and can be implemented by various configurations within a range that does not depart from the spirit and scope of the invention. For example, the technical features described in the embodiments and examples corresponding to the technical features of respective embodiments described in the summary section can be replaced or combined as appropriate in order to solve some or all of the above-described problems or achieve some or all of the above-described effects. Also, a technical feature that is not described as essential in the specification may be removed as appropriate.

What is claimed is:

1. A tank capable of supplying a liquid to a liquid ejection head, the tank comprising:

a liquid containing portion configured to contain the liquid; and an atmospheric air introducing portion configured to introduce atmospheric air into the liquid containing portion, the atmospheric air introducing portion comprising:

a buffer chamber configured to contain the atmospheric air;

a first opening located at a position on a liquid containing portion side of the buffer chamber; and a second opening located at a position on a side of the buffer chamber opposite to the liquid containing portion;

a liquid retaining member housed in the buffer chamber; and wherein a gap is located in the buffer chamber, the gap being configured to allow the atmospheric air to move between the first opening and the second opening.

2. The tank according to claim 1, wherein the gap is provided between the liquid retaining member and an inner wall of the buffer chamber.

3. The tank according to claim 1, wherein:

an extension of the liquid retaining member in a first direction is smaller than an extension of the buffer chamber in the first direction, and an extension of the liquid retaining member in a second direction orthogonal to the first direction is smaller than an extension of the buffer chamber in the second direction.

4. The tank according to claim 1, further comprising:

a protrusion protruding from an inner wall of the buffer chamber toward the liquid retaining member.

5. The tank according to claim 1, further comprising:

a first protrusion protruding in a first direction from a first inner wall of the buffer chamber toward the liquid retaining member; and a second protrusion protruding in a second direction, which is perpendicular to the first direction, from a second inner wall of the buffer chamber toward the liquid retaining member.

6. The tank according to claim 1, further comprising:

a protrusion protruding from the liquid retaining member toward an inner wall of the buffer chamber.

7. The tank according to claim 1, further comprising:

a first protrusion protruding in a first direction from the liquid retaining member toward a first inner wall of the buffer chamber; and a second protrusion protruding in a second direction, which is perpendicular to the first direction, from the liquid retaining member toward a second inner wall of the buffer chamber.

8. The tank according to claim 1, further comprising:

a support member located in the gap between an inner wall of the buffer chamber and the liquid retaining member.

9. The tank according to claim 1, further comprising:

a first support member located in a first portion of the gap that extends in a first direction between a first inner wall of the buffer chamber and the liquid retaining member; and a second support member located in a second portion of the gap that extends in a second direction between a second inner wall of the buffer chamber and the liquid retaining member, the second direction being perpendicular to the first direction.

10. The tank according to claim 1, wherein the liquid retaining member includes a plurality of plate-like members and a binding member that bundles the plurality of plate-like members.

11. The tank according to claim 1, further comprising:

a liquid injection portion capable of injecting the liquid into the liquid containing portion; and a cap member that is detachably attached to the liquid injection portion.

12. The tank according to claim 1, wherein the first opening opens to a first atmospheric air communication path that communicates between the buffer chamber and the liquid containing portion.

13. The tank according to claim 12, wherein:

the second opening opens to a second atmospheric air communication path that communicates between the buffer chamber and an outside of the tank.

14. The tank according to claim 13, wherein:

the buffer chamber is a first buffer chamber, the second atmospheric air communication path includes a second buffer chamber that is smaller than the first buffer chamber, the second buffer chamber is located further upstream than the first buffer chamber when a flow of the atmospheric air is defined in a direction from an outside of the tank to the liquid containing chamber, the liquid retaining member is a first liquid retaining member, a second liquid retaining member that is smaller than the first liquid retaining member is housed in the second buffer chamber, and a second gap is located in the second buffer chamber, the second gap configured to allow the atmospheric air to move between the second opening and the outside of the tank.

15. A tank unit comprising:

the tank according to claim 1; and a case that houses the tank.

16. A liquid ejection system comprising:

the tank unit according to claim 15;

a tube connected to the tank unit; and a liquid ejection apparatus connected to the tank unit via the tube, wherein the case is a first case, and the liquid ejection apparatus includes a liquid ejection head and a second case that houses the liquid ejection head.

* * * * *